US008466905B2

(12) United States Patent
Chung

(10) Patent No.: US 8,466,905 B2
(45) Date of Patent: Jun. 18, 2013

(54) DISPLAY, SCAN DRIVING APPARATUS FOR THE DISPLAY, AND DRIVING METHOD THEREOF

(75) Inventor: Kyung-Hoon Chung, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 0 days.

(21) Appl. No.: 12/984,875

(22) Filed: Jan. 5, 2011

(65) Prior Publication Data

US 2012/0013588 A1 Jan. 19, 2012

(30) Foreign Application Priority Data

Jul. 19, 2010 (KR) ..... 10-2010-0069541

(51) Int. Cl.
*G09G 5/00* (2006.01)

(52) U.S. Cl.
USPC ..... 345/204; 345/96; 345/100; 345/211

(58) Field of Classification Search
USPC ..... 345/84, 87, 96, 100, 204, 205, 211, 345/213
See application file for complete search history.

(56) References Cited

U.S. PATENT DOCUMENTS 4,446,532 A 5/1984 Baertsch et al.
5,410,583 A * 4/1995 Weisbrod et al. ..... 377/75
6,115,020 A 9/2000 Taguchi et al.
7,106,292 B2 * 9/2006 Moon ..... 345/100
2006/0061385 A1 3/2006 Jinta et al.
2006/0061560 A1 3/2006 Yamashita et al.
2006/0238482 A1 * 10/2006 Jang et al. ..... 345/100
2006/0244699 A1 * 11/2006 Yamazaki ..... 345/82
2007/0070021 A1 * 3/2007 Ahin et al. ..... 345/100
2008/0012816 A1 * 1/2008 Moon ..... 345/100
2008/0062097 A1 * 3/2008 Jeong et al. ..... 345/84
2008/0062112 A1 3/2008 Umezaki
2008/0074357 A1 3/2008 Kanda
2008/0079001 A1 4/2008 Umezaki et al.
2008/0079685 A1 4/2008 Umezaki et al.

(Continued)

FOREIGN PATENT DOCUMENTS

KR 10-2005-0104895 11/2005
KR 10-0714003 4/2007
KR 10-2010-0001697 1/2010

*Primary Examiner* — Amare Mengistu
*Assistant Examiner* — Premal Patel
(74) *Attorney, Agent, or Firm* — Robert E. Bushnell, Esq.

(57) ABSTRACT

A scan driving apparatus includes a first driving apparatus connected to a plurality of scan lines and a second driving apparatus connected to the plurality of scan lines. Wherein when one of the first driving apparatus and the second driving apparatus is in a scan enable state such that the plurality of scan lines are applied with a scan signal, the other is in a floating state such that the output terminal is floated. The scan driving apparatus according to the present invention has the function of a shift register for sequentially applying the scan signals and may apply a scan signal of a different waveform which is additionally required. The output terminal of the scan driving apparatus is floated in a period in which a different waveform is necessary such that a scan signal having the different waveform may be applied without influence of the scan signal, thereby realizing a complicated scan signal.

28 Claims, 16 Drawing Sheets

U.S. PATENT DOCUMENTS

| | | | | |
|---|---|---|---|---|
| 2008/0170029 | A1 | 7/2008 | Kim | |
| 2008/0211797 | A1* | 9/2008 | Lee et al. | 345/205 |
| 2008/0238830 | A1 | 10/2008 | Iida et al. | |
| 2008/0266275 | A1* | 10/2008 | Tsai et al. | 345/204 |
| 2008/0278467 | A1* | 11/2008 | Hwang et al. | 345/205 |
| 2008/0284698 | A1* | 11/2008 | Lee et al. | 345/87 |
| 2009/0080593 | A1* | 3/2009 | Kim et al. | 377/75 |
| 2009/0267878 | A1* | 10/2009 | Song et al. | 345/87 |
| 2009/0273555 | A1* | 11/2009 | Song et al. | 345/96 |
| 2010/0039411 | A1 | 2/2010 | Yatabe et al. | |
| 2010/0085282 | A1 | 4/2010 | Yu et al. | |
| 2010/0091006 | A1 | 4/2010 | Yoo et al. | |
| 2010/0133533 | A1 | 6/2010 | Umezaki | |
| 2010/0207927 | A1* | 8/2010 | Joo et al. | 345/213 |
| 2011/0109599 | A1* | 5/2011 | Han | 345/204 |
| 2011/0164017 | A1* | 7/2011 | Chung | 345/211 |

* cited by examiner

DISPLAY, SCAN DRIVING APPARATUS FOR THE DISPLAY, AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on Jul. 19, 2010 and there duly assigned Serial No. 10-2010-0069541.

BACKGROUND OF THE INVENTION

1. Field of the Invention

The present invention relates to a display device, a scan driving apparatus for the display device, and a driving method thereof. More particularly, the present invention relates to a display device, a scan driving apparatus for the display device, and a driving method thereof which are capable of outputting various scan signals.

2. Description of the Related Art

Currently, various flat panel displays which can have reduced weight and volume, which are drawbacks of the cathode ray tube, are being developed. As flat panel displays, there are a liquid crystal display (LCD), a field emission display (FED), a plasma display panel (PDP), and an organic light emitting diode (OLED) display.

The flat panel display includes a display panel consisting of a plurality of pixels arranged in a matrix format. The display panel includes a plurality of scan lines arranged in a row direction and a plurality of data lines arranged in a column direction, and the plurality of scan lines and the plurality of data lines intersect. The plurality of pixels are driven by scan signals and data signals transmitted through the corresponding scan lines and data lines.

The flat panel display is classified into a passive matrix light emitting display device and an active matrix light emitting display device according to the driving method thereof. Among them, the active matrix type, which selectively turns on/off the pixels, is mainly used in terms of resolution, contrast, and operation speed.

The active matrix organic light emitting diode (OLED) display writes a data signal in synchronization with the time that a scan signal is transmitted to a pixel. The scan signal may be transmitted to the scan line in a forward direction or a backward direction according to the arrangement of the scan line. The conventional scan driving apparatus has the function of a shift register for sequentially driving scan signals.

Recently, as the size of display panels has increased and the driving method thereof has become complicated, the waveform of the required scan signal has also become complicated. To realize a complicated waveform of the scan signal, the scan driving apparatus must apply various signals having different waveforms according to the case by executing the function of the conventional shift register.

The above information disclosed in this Background section is only for enhancement of an understanding of the background of the invention, and therefore it may contain information which does not form the prior art already known in this country to a person of ordinary skill in the art.

SUMMARY OF THE INVENTION

The present invention provides a display device, a scan driving apparatus, and a driving method thereof which are capable of applying complicated scan signals while performing the function of a shift register for sequentially applying scan signals.

A scan driving apparatus according to an exemplary embodiment of the present invention includes: a first driving apparatus connected to a plurality of scan lines; and a second driving apparatus connected to the plurality of scan lines; wherein, when one of the first driving apparatus and the second driving apparatus is in a scan enable state such that the plurality of scan lines are applied with a scan signal, the other is in a floating state such that the output terminal is floated.

The first driving apparatus may sequentially apply the plurality of scan signals to the plurality of scan lines.

The second driving apparatus may simultaneously apply the plurality of scan signals to the plurality of scan lines.

The first driving apparatus may sequentially apply the plurality of scan signals to the plurality of scan lines and the second driving apparatus may apply a control signal to the plurality of scan lines after the output terminal of the first driving apparatus is floated.

The first driving apparatus may simultaneously apply the plurality of scan signals to the plurality of scan lines and the second driving apparatus may apply a control signal to the plurality of scan lines after the output terminal of the first driving apparatus is floated.

At least one of the first driving apparatus and the second driving apparatus may include a plurality of scan driving blocks respectively connected to the plurality of scan lines, wherein each scan driving block may include: an output terminal connected to a corresponding scan line; a first transistor transmitting a voltage of a logic high level to the output terminal; and a second transistor transmitting a voltage of a logic low level to the output terminal; and a voltage for turning off the first transistor and the second transistor may be transmitted to the gate electrode of the first transistor and the second transistor according to the floating signal for floating the output terminal.

The scan driving block may further include: a floating signal input terminal receiving the floating signal as an input; a third transistor transmitting a voltage for turning off the first transistor to the gate electrode of the first transistor according to the floating signal; and a fourth transistor transmitting a voltage for turning off the second transistor to the gate electrode of the second transistor according to the floating signal.

The third transistor may include a gate electrode connected to the floating signal input terminal, one terminal connected to a power source having the voltage of the logic high level, and another terminal connected to the gate electrode of the first transistor.

The fourth transistor may include the gate electrode connected to the floating signal input terminal, one terminal connected to the power source having the voltage of the logic high level, and another terminal connected to the gate electrode of the second transistor.

A scan driving apparatus according to another exemplary embodiment of the present invention includes: a first scan driving block outputting a second clock signal to a first output terminal according to an input signal in synchronization with a first clock signal, and outputting a first voltage to the first output terminal according to a third clock signal; a second scan driving block outputting the third clock signal to the second output terminal in synchronization with the second clock signal according to the output signal of the first scan driving block, and outputting the first voltage to the second output terminal according to the first clock signal; and a third scan driving block outputting the first clock signal to the third output terminal in synchronization with the third clock signal according to the output signal of the second scan driving block, and outputting the first voltage to the third output terminal according to the second clock signal; wherein the first to third output terminals are floated from the first to third scan driving blocks according to the floating signal.

The second clock signal may be a signal by which the first clock signal is shifted by a duty of the first clock signal, and the third clock signal is a signal by which the second clock signal is shifted by the duty of the second clock signal.

The first scan driving block may include: a first transistor turned on by the second voltage transmitted according to the third clock signal, and transmitting the first voltage to the first output terminal; a second transistor turned on by the input signal transmitted according to the first clock signal, and transmitting the second clock signal to the first output terminal; a third transistor transmitting the first voltage to the gate electrode of the first transistor according to the floating signal to turn off the first transistor; and a fourth transistor transmitting the first voltage to the gate electrode of the second transistor according to the floating signal so as to turn off the second transistor.

The second scan driving block may include: a first transistor turned on by the second voltage transmitted according to the first clock signal, and transmitting the first voltage to the second output terminal; a second transistor turned on by the output signal of the first scan driving block transmitted according to the second clock signal, and transmitting the third clock signal to the second output terminal; a third transistor transmitting the first voltage to the gate electrode of the first transistor according to the floating signal to turn off the first transistor; and a fourth transistor transmitting the first voltage to the gate electrode of the second transistor according to the floating signal so as to turn off the second transistor.

The third scan driving block may include: a first transistor turned on by the second voltage transmitted according to the second clock signal, and transmitting the first voltage to the third output terminal; a second transistor turned on by the output signal of the second scan driving block transmitted according to the third clock signal, and transmitting the first clock signal to the third output terminal; a third transistor transmitting the first voltage to the gate electrode of the first transistor according to the floating signal so as to turn off the first transistor; and a fourth transistor transmitting the first voltage to the gate electrode of the second transistor according to the floating signal so as to turn off the second transistor.

A scan driving apparatus according to another exemplary embodiment of the present invention includes: an output terminal connected to a corresponding scan line; a first transistor transmitting a voltage of a logic high level to the output terminal; and a plurality of scan driving blocks including a second transistor transmitting a voltage of a logic low level to the output terminal; wherein a voltage for turning off the first transistor and the second transistor is transmitted to the gate electrode of the first transistor and the second transistor according to a floating signal floating the output terminal.

The scan driving block may further include: a floating signal input terminal receiving a floating signal as an input; a third transistor for transmitting a voltage turning off the first transistor to the gate electrode of the first transistor according to the floating signal; and a fourth transistor for transmitting a voltage turning off the second transistor to the gate electrode of the second transistor according to the floating signal.

The first transistor may be a p-channel field effect transistor.

The third transistor may include: a gate electrode connected to the floating signal input terminal; one terminal connected to the power source having the voltage of the logic high level; and another terminal connected to the gate electrode of the first transistor.

The second transistor may be a p-channel field effect transistor.

The fourth transistor may include: a gate electrode connected to the floating signal input terminal; one terminal connected to the power source having the voltage of the logic high level; and another terminal connected to the gate electrode of the second transistor.

The plurality of scan driving blocks may further include a sequential input terminal receiving the scan start signal or the output signal of the adjacent scan driving block as an input.

The plurality of scan driving blocks may further include: a fifth transistor turned on by the first scan clock signal, and transmitting a voltage for turning on the first transistor to the gate electrode of the first transistor; a sixth transistor turned on by the second scan clock signal, and transmitting a signal input to the sequential input terminal to the gate electrode of the second transistor; and a seventh transistor turned on by a signal input to the sequential input terminal, and transmitting a voltage for turning off the first transistor to the gate electrode of the first transistor.

The plurality of scan driving blocks may sequentially output the scan signals to the plurality of scan lines according to the signal input to the sequential input terminal.

The plurality of scan driving blocks may further include: a fifth transistor turned on by the first control signal, and transmitting a voltage for turning off the first transistor to the gate electrode of the first transistor; a sixth transistor turned on by the first control signal, and transmitting a voltage for turning on the second transistor to the gate electrode of the second transistor; a seventh transistor turned on by the second control signal, and transmitting a voltage for turning off the second transistor to the gate electrode of the second transistor; and an eighth transistor turned on by the second control signal, and transmitting a voltage for turning on the first transistor to the gate electrode of the first transistor.

The plurality of scan driving blocks may simultaneously apply the scan signals to the plurality of scan lines according to the first control signal and the second control signal.

A ninth transistor turned on by the voltage for turning on the second transistor, and transmitting a voltage for turning off the first transistor to the gate electrode of the first transistor, may be further included.

A tenth transistor turned on by the voltage for turning on the first transistor, and transmitting a voltage for turning off the second transistor to the gate electrode of the second transistor, may be further included.

A display device according to another exemplary embodiment of the present invention includes: a display unit including a plurality of pixels; a data driver applying a data signal to a plurality of data lines connected to the plurality of pixels; and a scan driver applying a scan signal to a plurality of scan lines connected to the plurality of pixels for the data signal to be applied to the plurality of pixels; wherein the scan driver includes a first driving apparatus connected to the plurality of scan lines and a second driving apparatus connected to the plurality of scan lines, and when one of the first driving apparatus and the second driving apparatus is in a scan enable state such that the plurality of scan lines are applied with a scan signal, the other is in a floating state such that the output terminal is floated.

The first driving apparatus may sequentially apply the plurality of scan signals to the plurality of scan lines.

The second driving apparatus may simultaneously apply the plurality of scan signals to the plurality of scan lines.

The first driving apparatus may sequentially apply the plurality of scan signals to the plurality of scan lines and the second driving apparatus may apply a control signal to the plurality of scan lines after the output terminal of the first driving apparatus is floated.

The first driving apparatus may simultaneously apply the plurality of scan signals to the plurality of scan lines and the second driving apparatus may apply a control signal to the plurality of scan lines after the output terminal of the first driving apparatus is floated.

At least one of the first driving apparatus and the second driving apparatus may include a plurality of scan driving blocks respectively connected to the plurality of scan lines, and each scan driving block may include: an output terminal connected to a corresponding scan line; a first transistor transmitting a voltage of a logic high level to the output terminal; and a second transistor transmitting a voltage of a logic low level to the output terminal; wherein a voltage for turning off the first transistor and the second transistor may be transmitted to the gate electrode of the first transistor and the second transistor according to the floating signal floating the output terminal.

The scan driving block may further include: a floating signal input terminal receiving the floating signal as an input; a third transistor transmitting a voltage for turning off the first transistor to the gate electrode of the first transistor according to the floating signal; and a fourth transistor transmitting a voltage for turning off the second transistor to the gate electrode of the second transistor according to the floating signal.

A driving method of a scan driving apparatus according to another exemplary embodiment of the present invention includes a scan enable step for transmitting a scan signal to a plurality of scan lines in a scan driving apparatus connected to the plurality of scan lines, and a floating step for floating an output terminal of the scan driving apparatus.

Another scan driving apparatus connected to the plurality of scan lines may be in a state such that the output terminal is floated in the scan enable step.

Another scan driving apparatus connected to the plurality of scan lines may be in a scan enable state such that the scan signal is transmitted to the plurality of scan lines.

A controller connected to the plurality of scan lines may transmit a control signal to the plurality of scan lines in the floating step.

The scan driving apparatus according to the present invention has the function of a shift register sequentially applying the scan signals, and may apply a scan signal of a different waveform which is additionally required.

Also, the output terminal of the scan driving apparatus is floated in a period in which a different waveform is necessary such that the scan signal having the different waveform may be applied without the influence of the scan signal, thereby realizing a complicated scan signal.

DETAILED DESCRIPTION OF THE INVENTION

Figure 1:
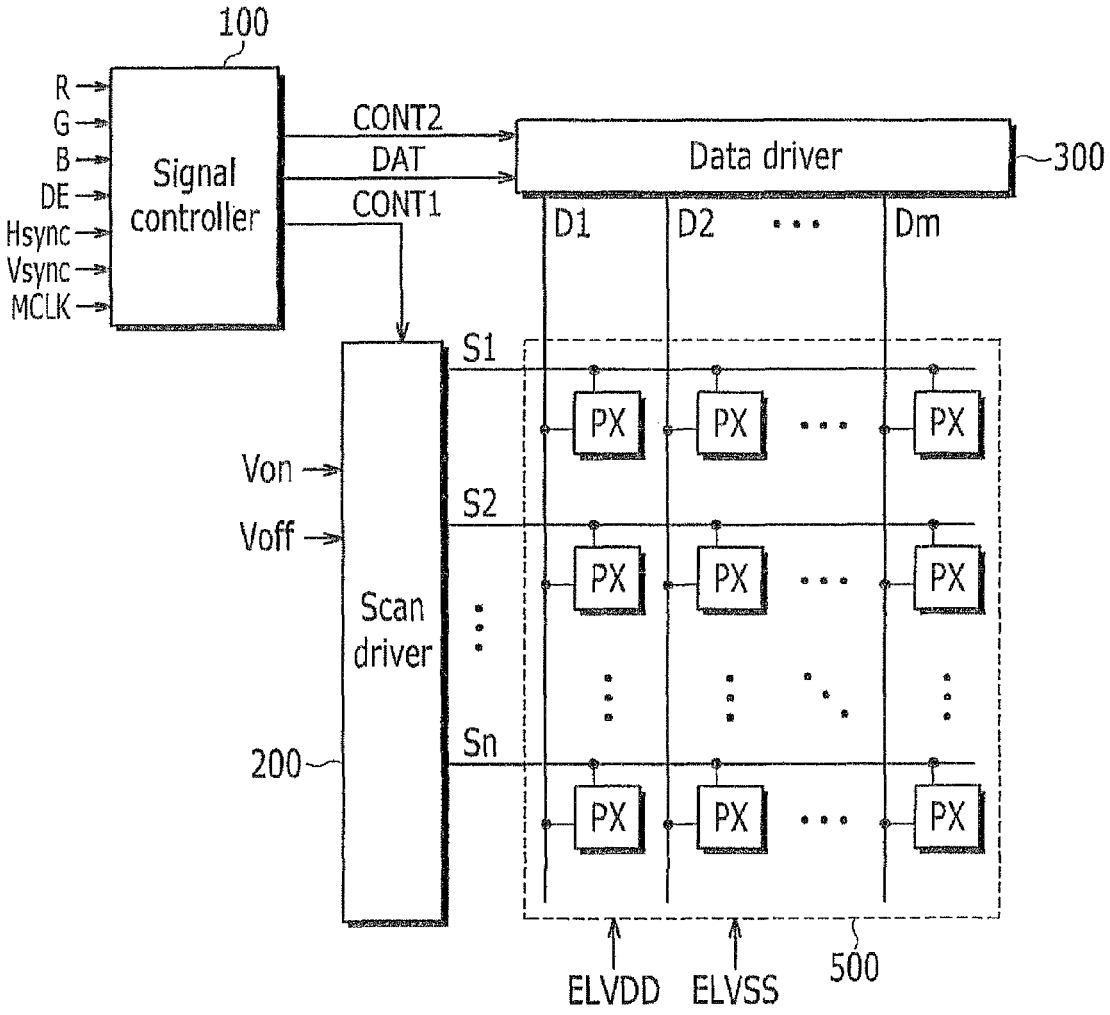
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art will realize, the described exemplary embodiments may be modified in various different ways, all without departing from the spirit or scope of the present invention.

Furthermore, in a plurality of exemplary embodiments, like reference numerals are used for components having the same configuration representatively in a first exemplary embodiment, and other configurations different from the first exemplary embodiment are described in the other exemplary embodiments.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the present invention.

Referring to FIG. 1, the display device includes a signal controller 100, a scan driver 200, a data driver 300, and a display unit 500.

The signal controller 100 receives a video signal (R, G, B) which is inputted from an external device, and an input control signal which controls displaying thereof. The video signal (R, G, B) includes luminance of each pixel PX, and the luminance has a grayscale having a predetermined number, for example, 1024=210, 256=28 or 64=26. As examples of the input control signal, there are a vertical synchronization signal Vsync, a horizontal synchronization signal Hsync, a main clock signal MCLK, and a data enable signal DE.

The signal controller 100 appropriately processes the input video signal (R, G, B) according to the operational condition of the display unit 500 and the data driver 300 on the basis of the input video signal (R, G, B) and the input control signal, and generates a scan control signal CONT1, a data control signal CONT2, and an image data signal DAT. The signal controller 100 transmits the scan control signal CONT1 to the scan driver 200. The signal controller 100 transmits the data control signal CONT2 and image data signal DAT to the data driver 300.

The display unit 500 includes a plurality of scan line S1-Sn, a plurality of data lines D1-Dm, and a plurality of pixels PX which are connected to a plurality of signal lines S1-Sn and D1-Dm, and arranged in a matrix form. A plurality of scan lines S1-Sn extend in an approximately row direction and almost parallel to each other. A plurality of data lines D1-Dm extend in an approximately column direction and almost parallel to each other. A plurality of pixels PX of the display unit 500 receive the first power source voltage ELVDD and the second power source voltage ELVSS from the outside. The level of the voltage values for the first power source voltage ELVDD and the second power source voltage ELVSS may be changed during one frame period, and this is controlled by the signal controller 100.

The scan driver 200 is connected to a plurality of scan lines S1-Sn, and applies a scan signal which includes a combination of a gate-on voltage Von that turns on the application of the data signal for the pixel and a gate-off voltage Voff that turns it off to the plurality of scan lines S1-Sn according to the scan control signal CONT1.

The scan control signal CONT1 includes a scan-start signal SSP, a scan clock signal SCLK, control signals SS and SR, and a floating signal FLS. The scan-start signal SSP is a signal for generating the first scan signal for displaying the image of one frame. The scan clock signal SCLK is a synchronization signal for sequentially applying the scan signals to the plurality of scan lines S1-Sn. The control signals SS and SR are signals for controlling the scan signals to be applied to the plurality of scan lines S1-Sn all together. The floating signal FLS is a signal for floating the output of the scan driver 200.

The data driver 300 is connected to a plurality of data lines D1-Dm, and selects a data voltage according to the image data signal DAT. The data driver 300 applies the selected data voltage as the data signal to a plurality of data lines D1-Dm according to the data control signal CONT2.

Each of the above-mentioned driving apparatus 100, 200, and 300 may be directly mounted outside the pixel area in the form of at least one IC chip, may be mounted on a flexible printed circuit film (not shown) and then mounted on the display unit 500 in the form of a tape carrier package (TCP), may be mounted on a separate printed circuit board (not shown), or may be integrated outside the pixel area together with the signal lines G1-Gn and D1-Dm.

The display device according to the present invention may be driven as a simultaneous emission type using a frame including a scan period in which the data signals are respectively written to the plurality of pixels PX and a light emitting period for light-emitting the plurality of pixels PX according to the written data signals.

Figure 2:
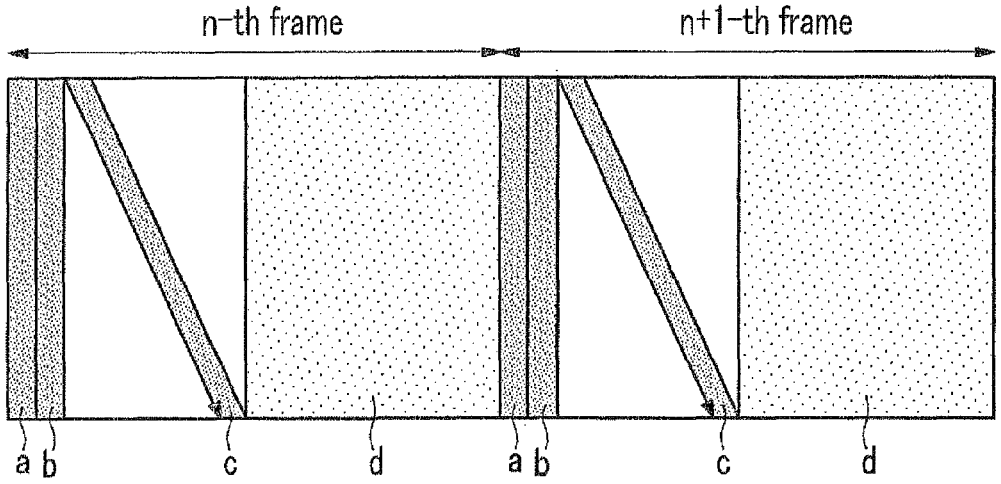
FIG. 2 is a view showing a driving operation of a display device of a simultaneous emission type according to an exemplary embodiment of the present invention.

FIG. 2 is a view showing a driving operation of a display device of a simultaneous emission type according to an exemplary embodiment of the present invention.

Referring to FIG. 2, it is assumed that the display device according to the present invention is an organic light emitting diode (OLED) display using an organic light emitting diode (OLED). However, the present invention is not limited thereto, and may be applied to various flat panel displays.

The driving method of the display device includes a reset step (a) for resetting the driving voltage of the organic light emitting diode (OLED) in the pixel, a threshold voltage compensation step (b) for compensating the threshold voltage of the driving transistor of the organic light emitting diode (OLED), a scan step (c) for transmitting the data signals to the plurality of pixels, and a light emitting step (d) in which the organic light emitting diode (OLED) of each pixel emits light corresponding to the transmitted data signals.

The scan step (c) is sequentially executed for each scan line, but the reset step (a), the threshold voltage compensation step (b), and the light emitting step (d) are simultaneously executed together in the entire display unit 500.

The scan driver 200 of the display device according to the present invention sequentially applies the scan signal of the gate-on voltage Von to the plurality of scan lines S1-Sn in the scan step (c), and simultaneously applies the scan signal of the gate-on voltage Von to the plurality of scan lines S1-Sn in the reset step (a) and the threshold voltage compensation step (b). That is, the scan driver 200 executes the sequential application and the simultaneous application of the scan signal according to the driving step of the display device. For this, the scan driver 200 may include the first driving apparatus for sequentially applying the scan signal of the gate-on voltage Von to the plurality of scan lines S1-Sn, and the second driving apparatus for simultaneously applying the scan signal of the gate-on voltage Von to the plurality of scan lines S1-Sn. Also, the scan driver 200 may include the first driving apparatus for applying the scan signals to the plurality of scan line S1-Sn and the second driving apparatus for applying the control signal.

Figure 3:
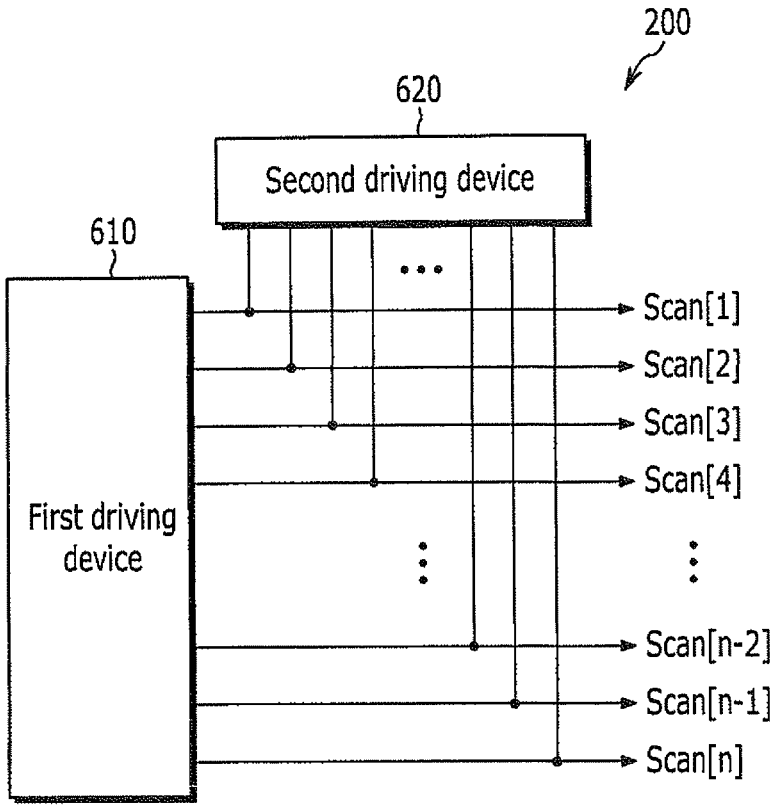
FIG. 3 is a block diagram of a scan driver according to an exemplary embodiment of the present invention.

FIG. 3 is a block diagram of a scan driver according to an exemplary embodiment of the present invention.

Referring to FIG. 3, the scan driver 200 includes a first driving apparatus 610 and a second driving apparatus 620 which are respectively connected to the plurality of scan lines S1-Sn.

In the scan driver 200 according to the first exemplary embodiment, the first driving apparatus 610 is a sequential driving apparatus for sequentially applying the scan signal of the gate-on voltage Von to the plurality of scan lines S1-Sn, and the second driving apparatus 620 is a simultaneous driving apparatus for simultaneously applying the scan signal of the gate-on voltage Von to the plurality of scan lines S1-Sn. The first driving apparatus 610 may sequentially apply the scan signal of the gate-on voltage Von to the plurality of scan lines S1-Sn in the scan step in which the data signals are transmitted to the plurality of pixels. The second driving apparatus 620 may simultaneously apply the scan signal of the gate-on voltage Von to the plurality of scan lines S1-Sn in the reset step for resetting the driving voltage of the organic light emitting diode (OLED) of the pixel and the threshold voltage compensation step for compensating the threshold voltage of the driving transistor of the pixel. When the scan signal of the gate-on voltage Von is sequentially applied to the plurality of scan lines S1-Sn in the first driving apparatus 610, the output terminal of the second driving apparatus 620 may be floated. When the scan signal of the gate-on voltage Von is simultaneously applied to the plurality of scan lines S1-Sn in the second driving apparatus 620, the output terminal of the first driving apparatus 610 may be floated. Accordingly, the first driving apparatus 610 and the second driving apparatus 620 affect each other, and the same plurality of scan lines S1-Sn may have with the scan signals Scan [1]-Scan [n] having different waveforms applied thereto.

In the scan driver 200 according to the second exemplary embodiment, the first driving apparatus 610 is the sequential driving apparatus for sequentially applying the scan signal to the plurality of scan lines S1-Sn, and the second driving apparatus 620 is a controller or other panel circuit for transmitting the control signal to the plurality of scan lines S1-Sn. The first driving apparatus 610 sequentially applies the scan signal of the gate-on voltage Von to the plurality of scan lines S1-Sn in the scan step for the sequential application of the scan signal. In the period in which the scan signal having the different waveform is necessary, the output terminal of the first driving apparatus 610 is floated, and the final scan signals Scan [1]-Scan [n] are outputted by the control signal output in the second driving apparatus 620.

In the scan driver 200 according to the third exemplary embodiment, the first driving apparatus 610 is the simultaneous driving apparatus for simultaneously applying the scan signal to the plurality of scan lines S1-Sn, and the second driving apparatus 620 is a controller or other panel circuit for transmitting the control signal to the plurality of scan lines S1-Sn. The first driving apparatus 610 simultaneously applies the scan signal of the gate on voltage Von to the plurality of scan lines S1-Sn in the period for the simultaneous application of the scan signal (e.g., the reset step (a), threshold voltage compensation step (b) etc., as described above). The final scan signals Scan [1]-Scan [n] are outputted by the control signal output from the second driving apparatus 620 after the output terminal of the first driving apparatus 610 is floated in the period in which the scan signal of a different waveform is required.

For the scan driver 200 according to second exemplary embodiment and the third exemplary embodiment, the controller or the other panel circuit connected to the plurality of scan lines S1-Sn is not limited to one, and a plurality of controllers or other panel circuits may be provided according to the waveform of the required scan signal.

As described above, the first driving apparatus 610 and the second driving apparatus 620 share the plurality of scan lines S1-Sn and are connected thereto, and like the first exemplary embodiment, the output terminal of one of the first driving apparatus 610 and the second driving apparatus 620 may be floated and the other may output the scan signal, or like the second exemplary embodiment and the third exemplary embodiment, after one of the first driving apparatus 610 and the second driving apparatus 620 outputs the scan signal, the output terminal thereof is floated and the other outputs the control signal, and finally the scan signal may be outputted. Accordingly, the scan driver 200 may easily realize a complicated scan signal.

Next, the scan driving apparatus (sequential driving apparatus) for sequentially applying the scan signal to a plurality of scan lines S1-Sn and the scan driving apparatus (simultaneous driving apparatus) for simultaneously applying the scan signal thereto, which are included in the scan driver 200, will be described.

The scan driving apparatus (sequential driving apparatus) according to the first exemplary embodiment is described as follows.

Figure 4:
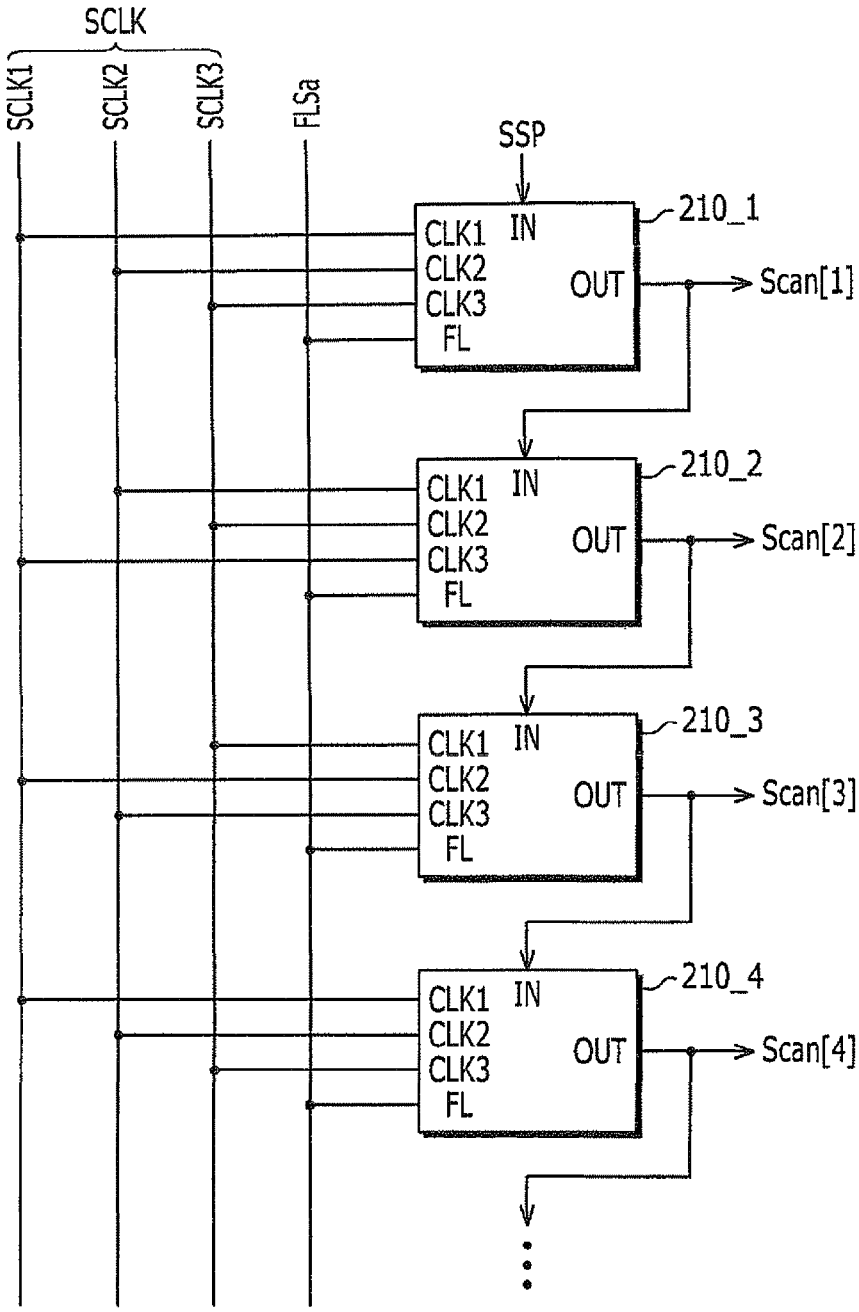
FIG. 4 is a block diagram of a configuration of a scan driving apparatus according to an exemplary embodiment of the present invention.

FIG. 4 is a block diagram showing a configuration of a scan driving apparatus according to an exemplary embodiment of the present invention.

Referring to FIG. 4, the scan driving apparatus according to the first exemplary embodiment includes a plurality of scan driving blocks 210_1, 210_2, 210_3, and 210_4, . . . for generating a plurality of scan signals. Each of the scan driving blocks 210_1, 210_2, 210_3, and 210_4, . . . receives an input signal to generate the scan signals Scan [1], Scan [2], Scan [3], Scan [4], . . . transmitted to the plurality of scan lines S1-Sn.

Each of the scan driving blocks 210_1, 210_2, 210_3, 210_4, . . . includes a first clock signal input terminal CLK1, a second clock signal input terminal CLK2, a third clock signal input terminal CLK3, a floating signal input terminal FL, a scan start signal SSP or a sequential input terminal IN receiving the output signal of the adjacent scan driving block as an input, and a scan signal output terminal OUT.

The input signal of each of the scan driving blocks 210_1, 210_2, 210_3, 210_4, . . . includes a plurality of scan clock signals SCLK, a floating signal FLSa, and a scan start signal SSP or the output signal of the adjacent scan driving block. The plurality of scan clock signals SCLK include a first scan clock signal SCLK1, a second scan clock signal SCLK2, and a third scan clock signal SCLK3. The plurality of scan clock signals SCLK1, SCLK2, and SCLK3, and the floating signal FLSa, are applied to different wires.

The continuous three scan driving blocks receive three scan clock signals SCLK1, SCLK2, and SCLK3 through different input terminals. For example, in the first scan driving block 210_1, the first clock signal input terminal CLK1 is connected to the wire of the first scan clock signal SCLK1, the second clock signal input terminal CLK2 is connected to the wire of the second scan clock signal SCLK2, and the third clock signal input terminal CLK3 is connected to the wire of the third scan clock signal SCLK3. In the second scan driving block 210_2, the first clock signal input terminal CLK1 is connected to the wire of the second scan clock signal SCLK2, the second clock signal input terminal CLK2 is connected to the wire of the third scan clock signal SCLK3, and the third clock signal input terminal CLK3 is connected to the wire of the first scan clock signal SCLK1. In the third scan driving block 210_3, the first clock signal input terminal CLK1 is connected to the wire of the third scan clock signal SCLK3, the second clock signal input terminal CLK2 is connected to the wire of the first scan clock signal SCLK1, and the third clock signal input terminal CLK3 is connected to the wire of the second scan clock signal SCLK2. That is, three scan clock signals SCLK1, SCLK2, and SCLK3 are input to the clock signal input terminals CLK1, CLK2, and CLK3 of the plurality of scan driving blocks 210_1, 210_2, 210_3, and 210_4, . . . as three types. A plurality of scan clock signals SCLK1, SCLK2, and SCLK3 are differently input to a plurality of clock signal input terminals CLK1, CLK2, and CLK3 between the adjacent scan driving blocks of a plurality of scan driving blocks 210_1, 210_2, 210_3, 210_4, . . . .

The floating signal input terminal FL of each of the scan driving blocks 210_1, 210_2, 210_3, 210_4, . . . is connected to the wire of the floating signal FLSa.

Each of the scan driving blocks 210_1, 210_2, 210_3, 210_4, . . . outputs the scan signals Scan [1], Scan [2], Scan [3], Scan [4], . . . , which are generated according to the signal input to the plurality of clock signal input terminals CLK1, CLK2, and CLK3, the floating signal input terminal FL, and the sequential input terminal IN, to the scan signal output terminal OUT. The plurality of scan driving blocks 210_1, 210_2, 210_3, 210_4, . . . sequentially output the scan signal according to the input of the output signal of the scan start signal SSP or the adjacent scan driving block.

The first scan driving block 210_1 receives the scan start signal SSP so as to generate the scan signal Scan [1], and transmits it to the first scan line S1 and the second scan driving block 210_2. The second scan driving block 210_2 receives the scan signal Scan [1] of the first scan driving block 210_1 so as to generate the scan signal Scan [2], and transmits it to the second scan line S2 and the third scan driving block 210_3. The third scan driving block 210_3 receives the scan signal Scan [2] of the second scan driving block 210_2 so as to generate the scan signal Scan [3], and transmits it to the third scan line S3 and the fourth scan driving block 210_4. That is, the (k+1)-th scan driving block receives the scan signal Scan [k] output from the k-th scan driving block as the adjacent scan driving block so as to generate and output the scan signal Scan [k+1] (1<=k<n). As described above, the scan signal is sequentially generated from the first scan driving block 210_1 to the n-th scan driving block (not shown), and is transmitted to the plurality of scan lines S1-Sn.

Figure 5:
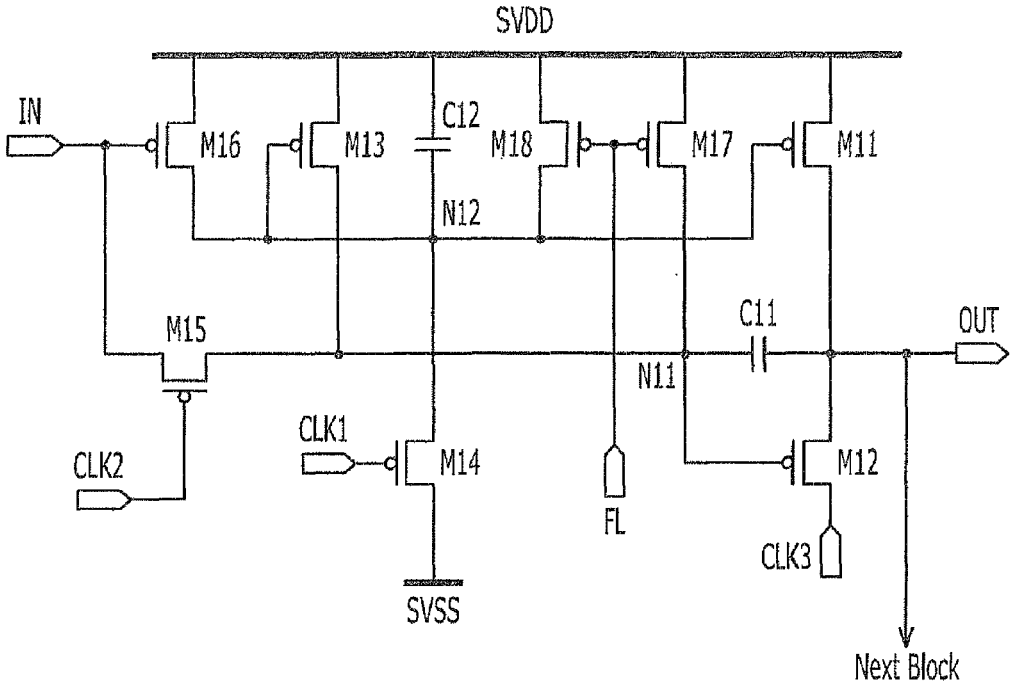
FIG. 5 is a circuit diagram of a scan driving block included in the scan driving apparatus of FIG. 4.

FIG. 5 is a circuit diagram showing a scan driving block included in the scan driving apparatus of FIG. 4.

Referring to FIG. 5, the scan driving block includes a plurality of input terminals CLK1, CLK2, CLK3, IN, and FL, a scan signal output terminal OUT, a plurality of transistors M11, M12, M13, M14, M15, M16, M17, and M18, and a plurality of capacitors C11 and C12.

The plurality of input terminals include the first clock signal input terminal CLK1, the second clock signal input terminal CLK2, the third clock signal input terminal CLK3, the floating signal input terminal FL, and the sequential input terminal IN.

The first transistor M11 includes a gate electrode connected to the second node N12, one terminal connected to the power source SVDD, and another terminal connected to the scan signal output terminal OUT. The second transistor M12 includes a gate electrode connected to the first node N11, one terminal connected to the third clock signal input terminal CLK3, and another terminal connected to the scan signal output terminal OUT. The third transistor M13 includes a gate electrode connected to the second node N12, one terminal connected to the power source SVDD, and another terminal connected to the first node N11. The fourth transistor M14 includes a gate electrode connected to the first clock signal input terminal CLK1, one terminal connected to the power source SVSS, and another terminal connected to the second node N12. The fifth transistor M15 includes a gate electrode connected to the second clock signal input terminal CLK2, one terminal connected to the sequential input terminal IN, and another terminal connected to the first node N11. The sixth transistor M16 includes a gate electrode connected to sequential input terminal IN, one terminal connected to the power source SVDD, and another terminal connected to the second node N12. The seventh transistor M17 includes a gate electrode connected to the floating signal input terminal FL, one terminal connected to the power source SVDD, and another terminal connected to the first node N11. The eighth transistor M18 includes a gate electrode connected to the floating signal input terminal FL, one terminal connected to the power source SVDD, and another terminal connected to the second node N12.

The first capacitor C11 includes one terminal connected to the first node N11 and another terminal connected to the scan signal output terminal OUT. The second capacitor C12 includes one terminal connected to the power source SVDD and another terminal connected to the second node N12.

The first node N11 is connected to the gate electrode of the second transistor M12, the other terminal of the third transistor M13, the other terminal of the fifth transistor M15, the other terminal of the seventh transistor M17, and one terminal of the first capacitor C11. The second node N12 is connected to the gate electrode of the first transistor M11, the gate electrode of the third transistor M13, the other terminal of the fourth transistor M14, the other terminal of the sixth transistor M16, the other terminal of the eighth transistor M18, and the other terminal of the second capacitor C12.

The power source SVDD is a power source having a voltage of the logic high level, and the power source SVSS is a power source having a voltage of the logic low level.

The plurality of transistors M11, M12, M13, M14, M15, M16, M17, and M18 are p-channel field effect transistors. The gate-on voltage for turning on the plurality of transistors M11, M12, M13, M14, M15, M16, M17, and M18 is the voltage of the logic low level and the gate-off voltage for turning them off is the voltage of the logic high level. At least one of the plurality of transistors M11, M12, M13, M14, M15, M16, M17, and M18 may be an n-channel field effect transistor, the gate-on voltage for turning on the n-channel field effect transistor is the voltage of the logic high level, and the gate-off voltage for turning it off is the voltage of the logic low level.

The first scan clock signal SCLK1, the second scan clock signal SCLK2, and the third scan clock signal SCLK3 may be applied with the logic low level voltage of the different cycles. That is, the signals inputted to the first clock signal input terminal CLK1, the second clock signal input terminal CLK2, and the third clock signal input terminal CLK3 may be applied with the logic low level of the different cycles.

When the first clock signal input terminal CLK1 is applied with the voltage of the logic low level and the sequential input terminal IN is applied with the voltage of the logic high level, the fourth transistor M14 is turned on, and the power source SVSS is transmitted to the gate electrode of the first transistor M11 so as to turn on the first transistor M11. The power source SVDD is output to the scan signal outputted terminal OUT through the first transistor M11. That is, the scan signal of the logic high level is outputted. Here, the sixth transistor M16 is turned off, the third transistor M13 is turned on, the power source SVDD voltage is transmitted to the gate electrode of the second transistor M12 through the third transistor M13, and thereby the second transistor M12 is turned off.

When the second clock signal input terminal CLK2 is applied with the voltage of the logic low level and the sequential input terminal IN is applied with the voltage of the logic low level, the fifth transistor M15 is turned on and the voltage of the logic low level applied to the sequential input terminal IN is transmitted to the gate electrode of the second transistor M12, and thereby the second transistor M12 is turned on. The voltage of the logic high level inputted to the third clock signal input terminal CLK3 is outputted to the scan signal output terminal OUT. Also, one terminal of the first capacitor C11 is applied with the voltage of the logic low level and the other terminal is applied with the voltage of the logic high level. Here, the sixth transistor M16 is turned on, and the power source SVDD voltage is transmitted to the gate electrode of the first transistor M11 and the gate electrode of the third transistor M13 such that the first transistor M11 and the third transistor M13 are turned off.

When the third clock signal input terminal CLK3 is applied with the voltage of the logic low level and the sequential input terminal IN is applied with the voltage of the logic high level, the first transistor M11, the third transistor M13, the fourth transistor M14, the fifth transistor M15, and the sixth transistor M16 are turned off. The voltage of the first node N11 is decreased to a voltage which is less than the voltage of the logic low level (power source SVSS) by a bootstrap operation due to the first capacitor C11 while the voltage applied to the third clock signal input terminal CLK3 is changed to the logic low level voltage from the logic high level voltage. Accordingly, the second transistor M12 is completely turned on, and the voltage of the logic low level is outputted to the scan signal output terminal OUT through the turned-on second transistor M12.

In the process (scan enable stable) in which the above-described three clock signal input terminals CLK1, CLK2, and CLK3 are applied with the voltage of the logic low level, the floating signal input terminal FL is applied with the voltage of the logic high level. The floating signal input terminal FL is applied with the voltage of the logic low level in the floating period in which the output terminal of the scan driving apparatus is floated.

If the floating signal input terminal FL is applied with the voltage of the logic high level, the seventh transistor M17 and the eighth transistor M18 are turned off, and the voltages applied to the gate electrode of the first transistor M11 and the gate electrode of the second transistor M12 are not affected. If the floating signal input terminal FL is applied with the voltage of the logic low level, the seventh transistor M17 and the eighth transistor M18 are turned on, the power source SVDD is transmitted to the gate electrode of the second transistor M12 through the turned on seventh transistor M17 such that the second transistor M12 is turned off, and the power source SVDD is transmitted to the gate electrode of the first transistor M11 through the turned on eighth transistor M18, thereby turning off the first transistor M11. That is, the seventh transistor M17 transmits the voltage of the logic high level for turning off the second transistor M12 according to the floating signal FLSa. The eighth transistor M18 transmits the voltage of the logic high level for turning off the first transistor M11 according to the floating signal FLSa. Accordingly, the scan signal output terminal OUT is placed in the floating state.

Figure 6:
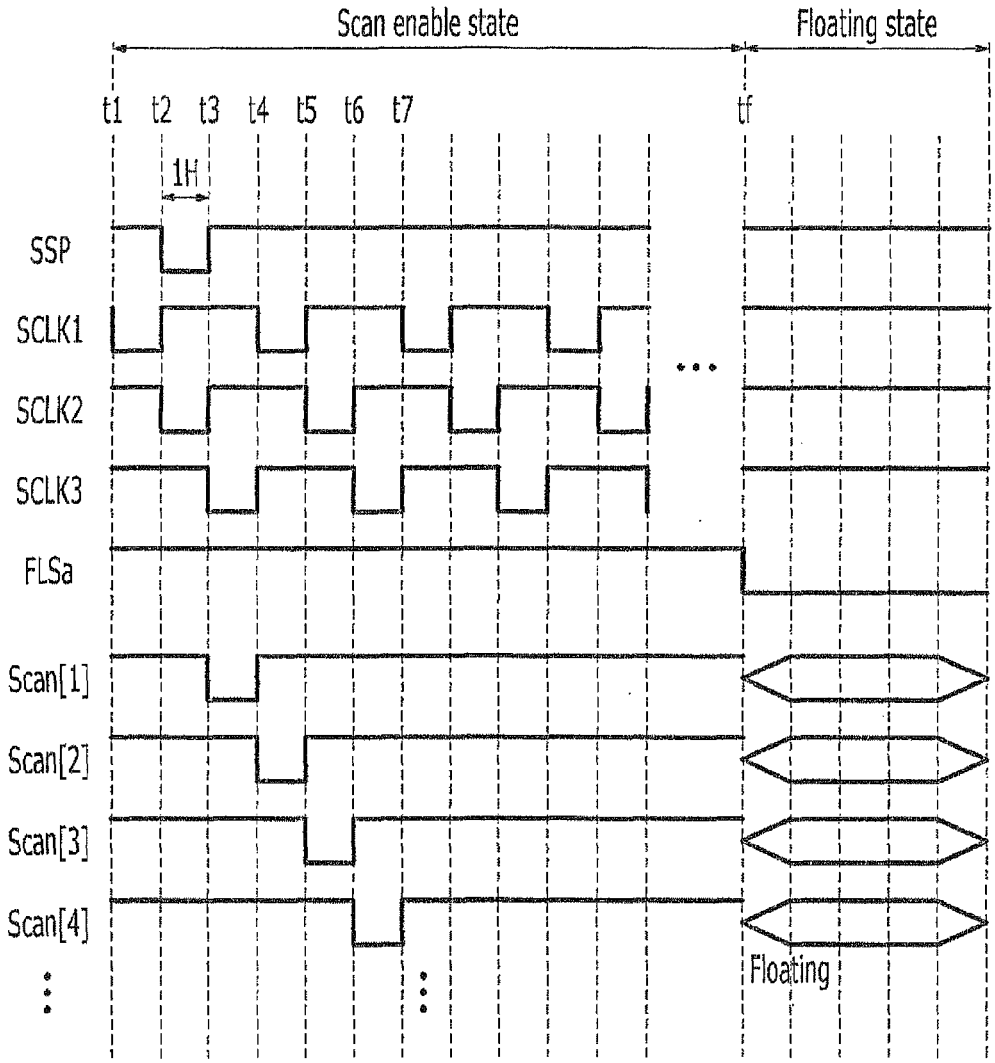
FIG. 6 is a timing diagram to explain a driving method of the scan driving apparatus of FIG. 4.

FIG. 6 is a timing diagram to explain a driving method of the scan driving apparatus of FIG. 4.

Referring to FIG. 4 to 6, the scan driving apparatus is operated in the scan enable state in which the floating signal FLSa is applied as the voltage of the logic high level for turning off the seventh transistor M17 and the eighth transistor M18 and the floating state in which the floating signal FLSa is applied as the voltage of the logic low level for turning on the seventh transistor M17 and the eighth transistor M18.

In the scan enable state, the first scan clock signal SCLK1, the second scan clock signal SCLK2, and the third scan clock signal SCLK3 are applied with the voltage of the logic low level at different cycles from each other as a unit of one horizontal cycle (1H, a horizontal synchronization signal (Hsync) and a data enable signal (DE)). The period in which the voltage for turning on the transistor included in the scan driving block is applied among one cycle of the clock signal is referred to as the duty of the clock signal. The second scan clock signal SCLK2 is the signal of which the first scan clock signal SCLK1 is shifted by the duty of the first scan clock signal SCLK1, and the third scan clock signal SCLK3 is the signal of which the second scan clock signal SCLK2 is shifted by the duty of the second scan clock signal SCLK2. Here, the cycle of the first scan clock signal SCLK1, the second scan clock signal SCLK2, and the third scan clock signal SCLK3 is three horizontal cycles, and each of the scan clock signals SCLK1, SCLK2, and SCLK3 is the signal that is shifted by one horizontal cycle.

In the period t1-t2, the first scan clock signal SCLK1 is applied as the voltage of the logic low level. The first scan clock signal SCLK1 is inputted to the first clock signal input terminal CLK1 of the first scan driving block 210_1 such that the first scan driving block 210_1 outputs the scan signal Scan [1] of the logic high level.

In the period t2-t3, the second scan clock signal SCLK2 and the scan start signal SSP are applied with the voltage of the logic low level. The second scan clock signal SCLK2 is inputted to the second clock signal input terminal CLK2 of the first scan driving block 210_1, and the scan start signal SSP is inputted to the sequential input section IN of the first scan driving block 210_1, and thereby the first scan driving block 210_1 outputs the scan signal Scan [1] of the logic high level. Here, one terminal of the first capacitor C11 of the first scan driving block 210_1 is applied with the voltage of the logic low level and the other terminal is applied with the voltage of the logic high level for the charge.

In the period t3-t4, the third scan clock signal SCLK3 is applied with the voltage of the logic low level. The third scan clock signal SCLK3 is inputted to the third clock signal input terminal CLK3 of first scan driving block 210_1 such that the first scan driving block 210_1 transmits the voltage of the logic low level to the scan signal output terminal OUT through the second transistor M12 which is completely turned on by the bootstrap operation through the first capacitor C11 so as to output the scan signal Scan [1] of the logic low level.

On the other hand, in the period t3-t4, the second scan driving block 210_2 receives the scan signal Scan [1] of the logic low level of the first scan driving block 210_1 with the sequential input terminal IN, and receives the third scan clock signal SCLK3 of the logic low level with the second clock signal input terminal CLK2. The second scan driving block 210_2 charges the first capacitor C11 while outputting the scan signal Scan [2] of the logic high level.

In the period t4-t5, the first scan clock signal SCLK1 is applied with the voltage of the logic low level, and the first scan clock signal SCLK1 is inputted to the third clock signal input terminal CLK3 of the second scan driving block 210_2. The second scan driving block 210_2 transmits the voltage of the logic low level to the scan signal output terminal OUT through the second transistor M12 which is completely turned on by the bootstrap operation through the first capacitor C11 so as to output the scan signal Scan [2] of the logic low level.

In the period t4-t5, the third scan driving block 210_3 receives the scan signal Scan [2] of the logic low level of the second scan driving block 210_2 with the sequential input terminal IN, and receives the first scan clock signal SCLK1 of the logic low level with the second clock signal input terminal CLK2. The third scan driving block 210_3 charges the first capacitor C11 while outputting the scan signal Scan [3] of the logic high level.

In the period t5-t6, the second scan clock signal SCLK2 is applied with the voltage of the logic low level, and the second scan clock signal SCLK2 is inputted with the third clock signal input terminal CLK3 of the third scan driving block 210_3. The third scan driving block 210_3 transmits the voltage of the logic low level to the scan signal output terminal OUT through the second transistor M12 which is completely turned on by the bootstrap operation through the first capacitor C11 so as to output the scan signal Scan [3] of the logic low level.

The fourth scan driving block 210_4 is connected to the wire of a plurality of scan clock signals SCLK1, SCLK2, and SCLK3 like the first scan driving block 210_1 such that each of the input terminals CLK1, CLK2, and CLK3 receives the same scan clock signals SCLK1, SCLK2, and SCLK3, respectively. The fourth scan driving block 210_4 outputs the scan signal Scan [4] of the logic low level in the period t6-t7.

As described above, the scan driving apparatus may sequentially output the scan signals in the scan enable state by using the scan signals of the first scan clock signal SCLK1, the second scan clock signal SCLK2, the third scan clock signal SCLK3, and the scan start signal SSP or the adjacent scan driving block which are applied with the voltage of the logic low level at the different cycles. When the cycles of the first scan clock signal SCLK1, the second scan clock signal SCLK2, and the third scan clock signal SCLK3 are three horizontal cycles and the duty is one horizontal cycle, scan signals having the duty of one horizontal cycle are shifted by one horizontal cycle, and are sequentially outputted to the plurality of scan lines S1-Sn.

The scan driving apparatus is operated with the floating state in which the scan signal output terminal OUT is floated from the time that the floating signal FLSa is applied with the voltage of the logic low level. Upon the operation of the floating state, the scan start signal SSP and the scan clock signals SCLK1, SCLK2, and SCLK3 are applied with the voltage of the logic high level. If the floating signal FLSa is applied with the voltage of the logic low level, the first node N11 and the second node N12 are both applied with the power source SVDD such that the first transistor M11 and the second transistor M12 are turned off and the scan signal output terminal OUT is placed in the floating state. Accordingly, the scan driving apparatus does not affect the other scan signals or the control signal applied to the plurality of scan lines S1-Sn in the state in which the output terminal is floated.

If the floating signal FLSa is again applied with the voltage of the logic high level, the scan driving apparatus is returned to the scan enable state, and thereby the scan signal may be outputted.

The scan driving apparatus (sequential driving apparatus) according to the second exemplary embodiment is now described.

Figure 7:
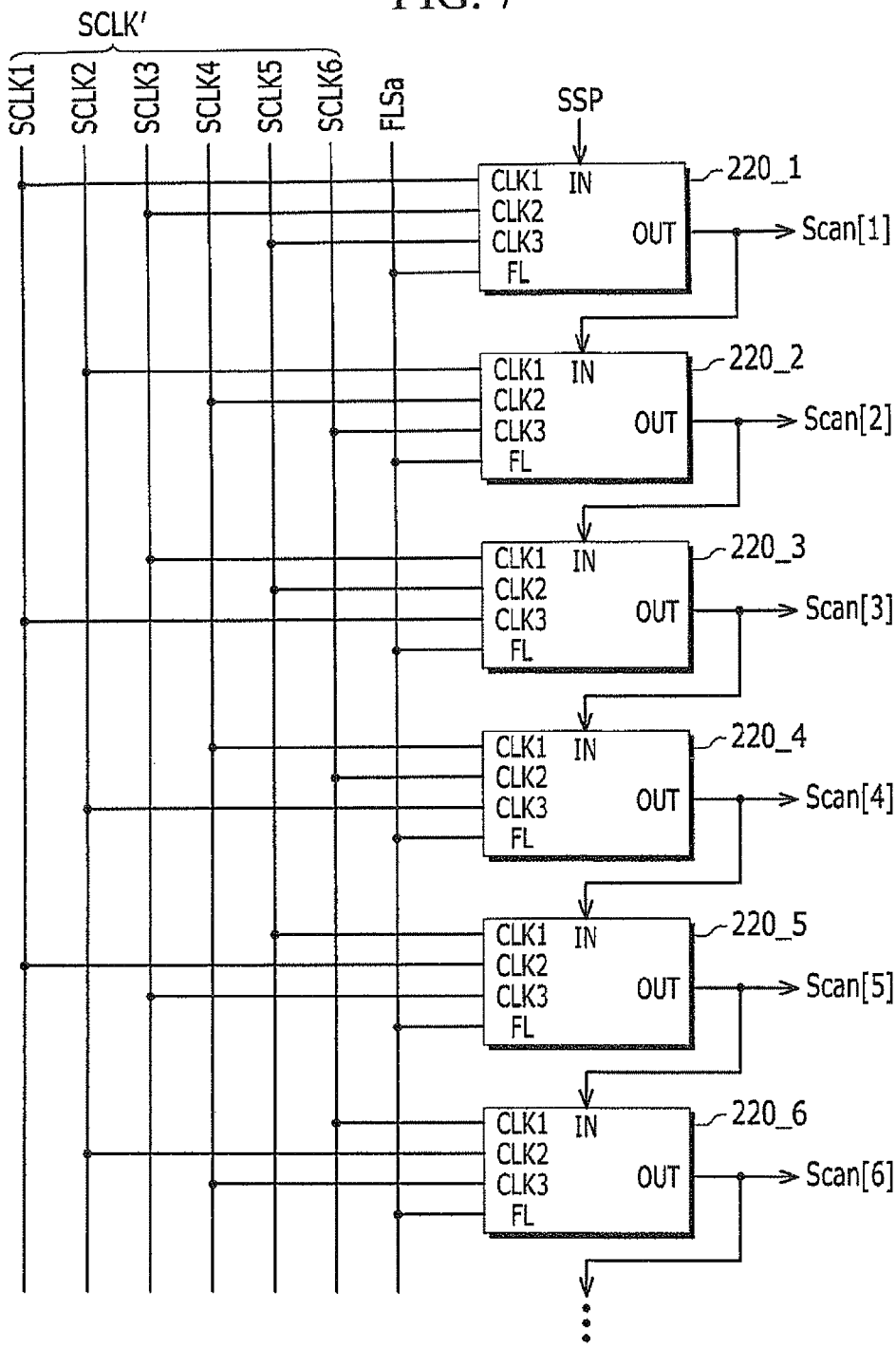
FIG. 7 is a block diagram of a configuration of a scan driving apparatus according to another exemplary embodiment of the present invention.

FIG. 7 is a block diagram showing a configuration of a scan driving apparatus according to another exemplary embodiment of the present invention. The different characteristics from the scan driving apparatus according to the first exemplary embodiment will mainly be described.

Referring to FIG. 7, the scan driving apparatus according to the second exemplary embodiment includes a plurality of scan driving blocks 220_1, 220_2, 220_3, 220_4, 220_5, 220_6, . . . for generating a plurality of scan signals. Each of the scan driving blocks 220_1, 220_2, 220_3, 220_4, 220_5, 220_6, . . . receives an input signal so as to generate the scan signals Scan [1], Scan [2], Scan [3], Scan [4], Scan [5], Scan [6] . . . transmitted to the plurality of scan lines S1-Sn.

Each of the scan driving blocks 220_1, 220_2, 220_3, 220_4, 220_5, 220_6, . . . may be constituted like the scan driving blocks of FIG. 5.

The plurality of scan clock signals SCLK' include the first scan clock signal SCLK1, the second scan clock signal SCLK2, the third scan clock signal SCLK3, the fourth scan clock signal SCLK4, the fifth scan clock signal SCLK5, and the sixth scan clock signal SCLK6. The plurality of scan clock signals SCLK1, SCLK2, SCLK3, SCLK4, SCLK5, and SCLK6, and the floating signal FLSa are applied to different wires.

The continuous six scan driving blocks receive the six scan clock signals SCLK1, SCLK2, SCLK3, SCLK4, SCLK5, and SCLK6 on different input terminals. For example, in the first scan driving block 220_1, the first clock signal input terminal CLK1 is connected to the wire of the first scan clock signal SCLK1, the second clock signal input terminal CLK2 is connected to the wire of the third scan clock signal SCLK3, and the third clock signal input terminal CLK3 is connected to the wire of the fifth scan clock signal SCLK5. In the second scan driving block 220_2, the first clock signal input terminal CLK1 is connected to the wire of the second scan clock signal SCLK2, the second clock signal input terminal CLK2 is connected to the wire of the fourth scan clock signal SCLK4, and the third clock signal input terminal CLK3 is connected to the wire of the sixth scan clock signal SCLK6. In the third scan driving block 220_3, the first clock signal input terminal CLK1 is connected to the wire of the third scan clock signal SCLK3, the second clock signal input terminal CLK2 is connected to the wire of the fifth scan clock signal SCLK5, and the third clock signal input terminal CLK3 is connected to the wire of the first scan clock signal SCLK1. In the fourth scan driving block 220_4, the first clock signal input terminal CLK1 is connected to the wire of the fourth scan clock signal SCLK4, the second clock signal input terminal CLK2 is connected to the wire of the sixth scan clock signal SCLK6, and the third clock signal input terminal CLK3 is connected to the wire of the second scan clock signal SCLK2. In the fifth scan driving block 220_5, the first clock signal input terminal CLK1 is connected to the wire of the fifth scan clock signal SCLK5, the second clock signal input terminal CLK2 is connected to the wire of the first scan clock signal SCLK1, and the third clock signal input terminal CLK3 is connected to the wire of the third scan clock signal SCLK3. In the sixth scan driving block 220_6, the first clock signal input terminal CLK1 is connected to the wire of the sixth scan clock signal SCLK6, the second clock signal input terminal CLK2 is connected to the wire of the second scan clock signal SCLK2, and the third clock signal input terminal CLK3 is connected to the wire of the fourth scan clock signal SCLK4. That is, six scan clock signals SCLK1, SCLK2, SCLK3, SCLK4, SCLK5, and SCLK6 are inputted to the clock signal input terminals CLK1, CLK2, and CLK3 of the plurality of scan driving blocks 220_1, 220_2, 220_3, 220_4, 220_5, and 220_6, . . . with six types.

The floating signal input terminals FL of the scan driving blocks 220_1, 220_2, 220_3, 220_4, 220_5, and 220_6, . . . are connected to the wire of the floating signal FLSa.

The scan driving blocks 220_1, 220_2, 220_3, 220_4, 220_5, and 220_6, . . . output the scan signals Scan [1], Scan [2], Scan [3], Scan [4], Scan [5], and Scan [6], . . . , which are generated according to the signals inputted to a plurality of clock signal input terminals CLK1, CLK2, and CLK3, the floating signal input terminal FL, and the sequential input terminal IN, to the scan signal output terminals OUT. The n-th scan driving block (not shown) from the first scan driving block 220_1 sequentially generates the scan signal so as to transmit it to the plurality of scan lines S1-Sn.

Figure 8:
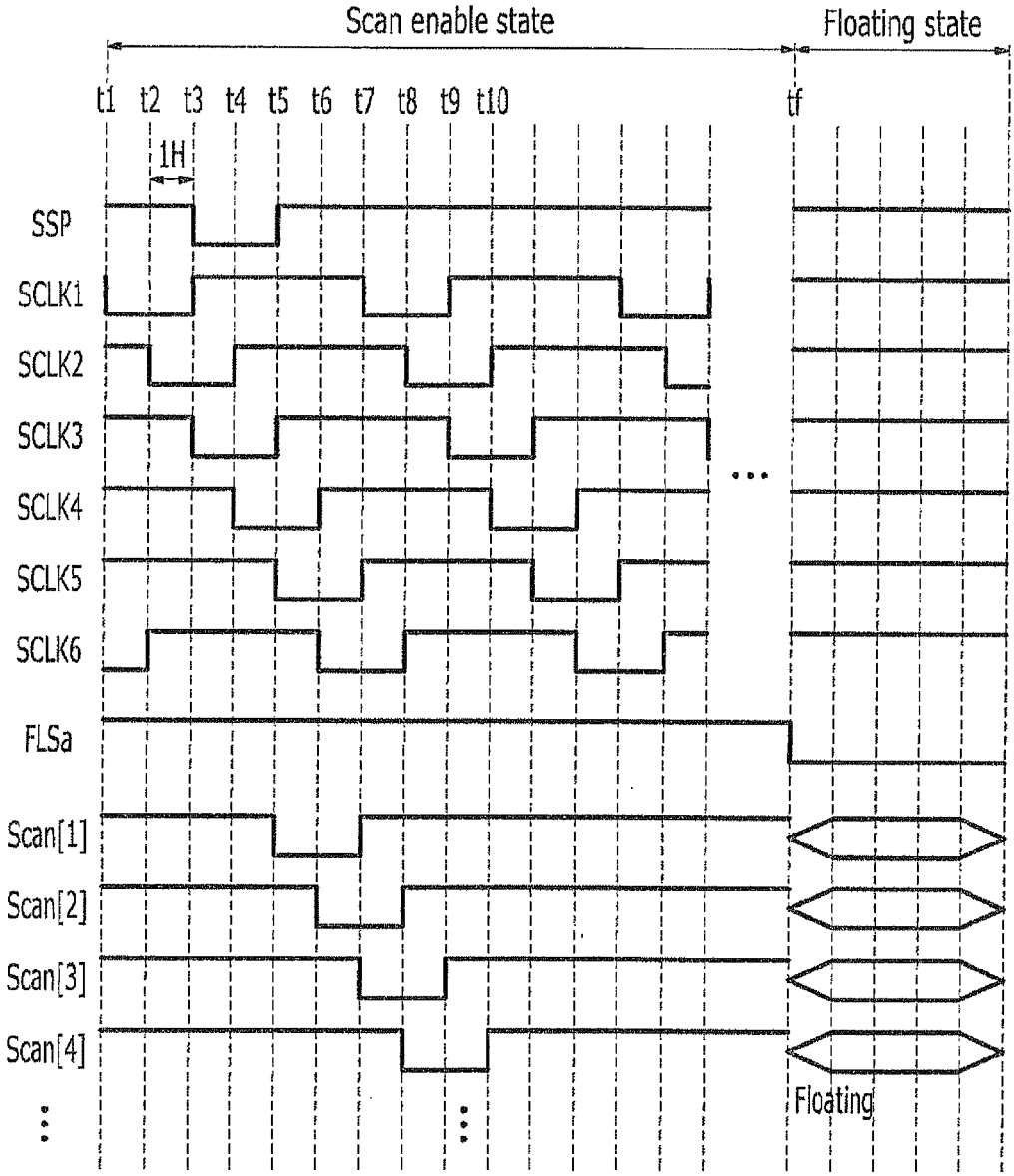
FIG. 8 is a timing diagram to explain a driving method of the scan driving apparatus of FIG. 7.

FIG. 8 is a timing diagram to explain the driving method of the scan driving apparatus of FIG. 7.

Referring to FIGS. 7 and 8, in the scan enable state, the voltages of the logic low level of the scan clock signals SCLK1, SCLK2, SCLK3, SCLK4, SCLK5, and SCLK6 have the pulse width of two horizontal cycles 2H, and are applied to be overlapped by one horizontal cycle 1H with the scan clock signal of the adjacent wire. The voltages of the logic low level of the scan clock signals SCLK1, SCLK2, SCLK3, SCLK4, SCLK5, and SCLK6 are applied so as to be repeated with the interval of four horizontal cycles 4H in which the voltage of the logic high level is applied. Here, the cycle of the scan clock signals SCLK1, SCLK2, SCLK3, SCLK4, SCLK5, and SCLK6 is six horizontal cycles, and the duty is two horizontal cycles.

The scan start signal SSP is applied with the voltage of the logic low level in the period t3-t5. The first scan clock signal SCLK1 in the period t1-t3, the second scan clock signal SCLK2 in the period t2-t4, the third scan clock signal SCLK3 in the period t3-t5, the fourth scan clock signal SCLK4 in the period t4-t6, the fifth scan clock signal SCLK5 in the period t5-t7, and the sixth scan clock signal SCLK6 in the period t6-t8 are respectively applied with the voltage of the logic low level.

The first clock signal input terminal CLK1 of the first scan driving block 220_1 is inputted with the first scan clock signal SCLK1, the second clock signal input terminal CLK2 is inputted with the third scan clock signal SCLK3, and the third clock signal input terminal CLK3 is inputted with the fifth scan clock signal SCLK5. The first scan driving block 220_1 outputs the scan signal Scan [1] of the logic low level in the period t5-t7.

The first clock signal input terminal CLK1 of the second scan driving block 220_2 is inputted with the second scan clock signal SCLK2, the second clock signal input terminal CLK2 is inputted with the fourth scan clock signal SCLK4, and the third clock signal input terminal CLK3 is inputted with the sixth scan clock signal SCLK6. The second scan driving block 220_2 outputs the scan signal Scan [2] of the logic low level in the period t6-t8.

The first clock signal input terminal CLK1 of the third scan driving block 220_3 is inputted with the third scan clock signal SCLK3, the second clock signal input terminal CLK2 is inputted with the fifth scan clock signal SCLK5, and the third clock signal input terminal CLK3 is inputted with the first scan clock signal SCLK1. The third scan driving block 220_3 outputs the scan signal Scan [3] of the logic low level in the period t7-t9.

The first clock signal input terminal CLK1 of the fourth scan driving block 220_4 is inputted with the fourth scan clock signal SCLK4, the second clock signal input terminal CLK2 is inputted with the sixth scan clock signal SCLK6, and the third clock signal input terminal CLK3 is inputted with the second scan clock signal SCLK2. The fourth scan driving block 220_4 outputs the scan signal Scan [4] of the logic low level in the period t8-t10.

By this method, the scan driving apparatus may sequentially output from the first scan signal Scan [1] to the n-th scan signal Scan [n] in the scan enable state. When the cycles of the scan clock signal SCLK1, SCLK2, SCLK3, SCLK4, SCLK5, and SCLK6 are six horizontal cycles and the duty is two horizontal cycles, a plurality of scan signals having the duty of two horizontal cycles are shifted by one horizontal cycle and are sequentially outputted to the plurality of scan lines S1-Sn.

The scan driving apparatus is operated with the floating state in which the scan signal output terminal OUT is floated from the time that the floating signal FLSa is applied with the voltage of the logic low level. Upon the operation of the floating state, the scan start signal SSP and the scan clock signals SCLK1, SCLK2, SCLK3, SCLK4, SCLK5, and SCLK6 are applied with the voltage of the logic high level.

If the floating signal FLSa is again applied with the voltage of the logic high level, the scan driving apparatus is returned to the scan enable state, thereby outputting the scan signal.

The scan driving apparatus (the sequential driving apparatus) according to third exemplary embodiment is now described.

Figure 9:
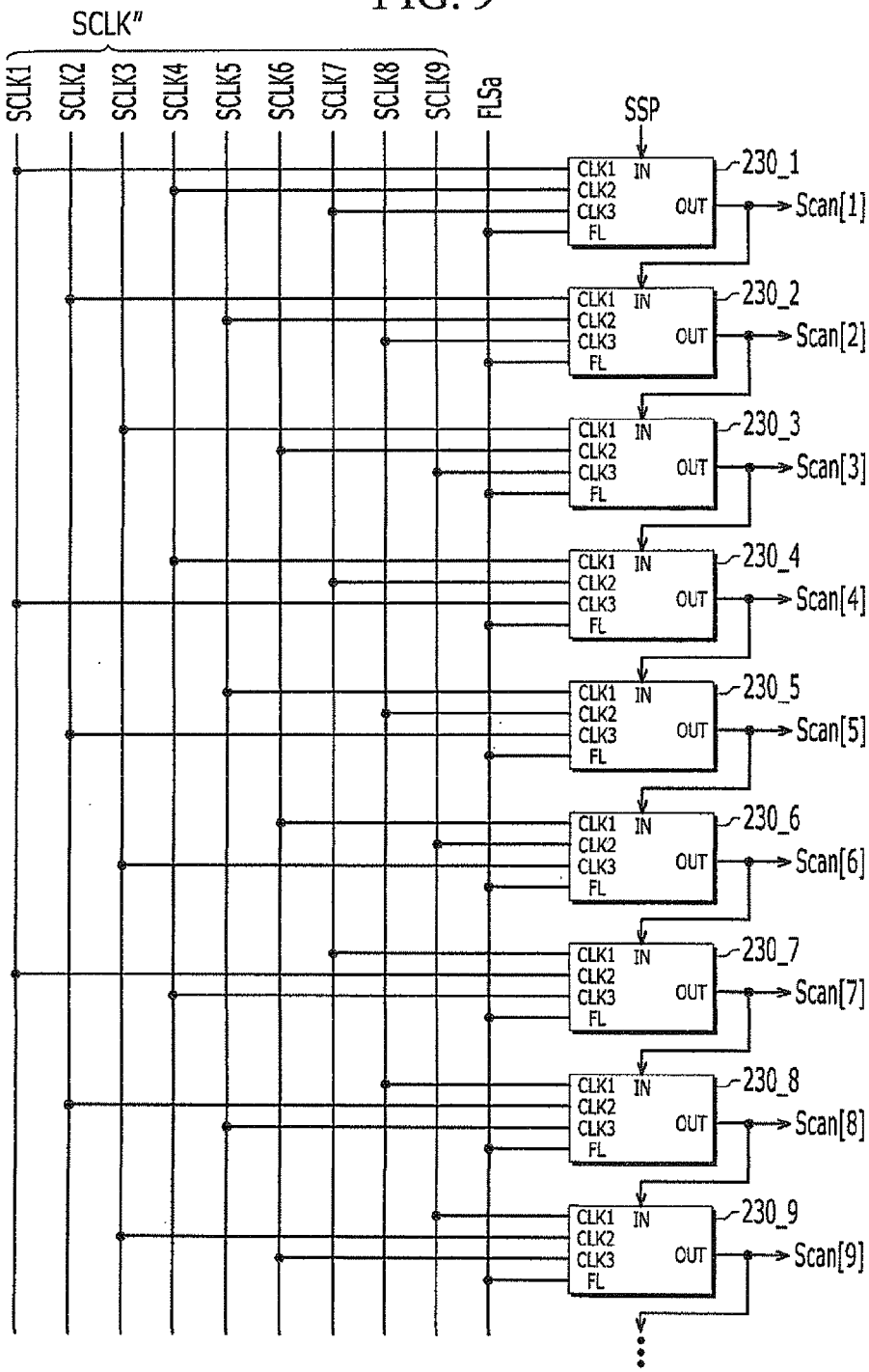
FIG. 9 is a block diagram of a configuration of a scan driving apparatus according to another exemplary embodiment of the present invention.

FIG. 9 is a block diagram showing a configuration of a scan driving apparatus according to another exemplary embodiment of the present invention. The differences will be described compared with the scan driving apparatus according to the first exemplary embodiment or the scan driving apparatus according to the second exemplary embodiment.

Referring to FIG. 9, the scan driving apparatus according to the third exemplary embodiment includes a plurality of scan driving blocks 230_1, 230_2, 230_3, 230_4, 230_5, 230_6, 230_7, 230_8, and 230_9, . . . for generating the plurality of scan signals. The scan driving blocks 230_1, 230_2, 230_3, 230_4, 230_5, 230_6, 230_7, 230_8, and 230_9, . . . receive the input signal to generate the scan signals Scan [1], Scan [2], Scan [3], Scan [4], Scan [5], Scan [6], Scan [7], Scan [8], Scan [9], . . . that are transmitted to the plurality of scan lines S1-Sn.

The scan driving blocks 230_1, 230_2, 230_3, 230_4, 230_5, 230_6, 230_7, 230_8, and 230_9, . . . may be like the scan driving blocks of FIG. 5.

The plurality of scan clock signals SCLK" include the first scan clock signal SCLK1, the second scan clock signal SCLK2, the third scan clock signal SCLK3, the fourth scan clock signal SCLK4, the fifth scan clock signal SCLK5, the sixth scan clock signal SCLK6, the seventh scan clock signal SCLK7, the eighth scan clock signal SCLK8, and the ninth scan clock signal SCLK9. The plurality of scan clock signals SCLK1, SCLK2, SCLK3, SCLK4, SCLK5, SCLK6, SCLK7, SCLK8, and SCLK9 and the floating signal FLSa are applied on different wires.

The continuous scan driving blocks receive the nine scan clock signals SCLK1, SCLK2, SCLK3, SCLK4, SCLK5, SCLK6, SCLK7, SCLK8, and SCLK9 through different input terminals. For example, in the first scan driving block 230_1, the first clock signal input terminal CLK1 is connected to the wire of the first scan clock signal SCLK1, the second clock signal input terminal CLK2 is connected to the wire of the fourth scan clock signal SCLK4, and the third clock signal input terminal CLK3 is connected to the wire of the seventh scan clock signal SCLK7. In the second scan driving block 230_2, the first clock signal input terminal CLK1 is connected to the wire of the second scan clock signal SCLK2, the second clock signal input terminal CLK2 is connected to the wire of the fifth scan clock signal SCLK5, and the third clock signal input terminal CLK3 is connected to the wire of the eighth scan clock signal SCLK8. In the third scan driving block 230_3, the first clock signal input terminal CLK1 is connected to the wire of the third scan clock signal SCLK3, the second clock signal input terminal CLK2 is connected to the wire of the sixth scan clock signal SCLK6, and the third clock signal input terminal CLK3 is connected to the wire of the ninth scan clock signal SCLK9. In the fourth scan driving block 230_4, the first clock signal input terminal CLK1 is connected to the wire of the fourth scan clock signal SCLK4, the second clock signal input terminal CLK2 is connected to the wire of the seventh scan clock signal SCLK7, and the third clock signal input terminal CLK3 is connected to the wire of the first scan clock signal SCLK1. In the fifth scan driving block 230_5, the first clock signal input terminal CLK1 is connected to the wire of the fifth scan clock signal SCLK5, the second clock signal input terminal CLK2 is connected to the wire of the eighth scan clock signal SCLK8, and the third clock signal input terminal CLK3 is connected to the wire of the second scan clock signal SCLK2. In the sixth scan driving block 230_6, the first clock signal input terminal CLK1 is connected to the wire of the sixth scan clock signal SCLK6, the second clock signal input terminal CLK2 is connected to the wire of the ninth scan clock signal SCLK9, and the third clock signal input terminal CLK3 is connected to the wire of the third scan clock signal SCLK3. In the seventh scan driving block 230_7, the first clock signal input terminal CLK1 is connected to the wire of the seventh scan clock signal SCLK7, the second clock signal input terminal CLK2 is connected to the wire of the first scan clock signal SCLK1, and the third clock signal input terminal CLK3 is connected to the wire of the fourth scan clock signal SCLK4. In the eighth scan driving block 230_8, the first clock signal input terminal CLK1 is connected to the wire of the eighth scan clock signal SCLK8, the second clock signal input terminal CLK2 is connected to the wire of the second scan clock signal SCLK2, and the third clock signal input terminal CLK3 is connected to the wire of the fifth scan clock signal SCLK5. In the ninth scan driving block 230_9, the first clock signal input terminal CLK1 is connected to the wire of the ninth scan clock signal SCLK9, the second clock signal input terminal CLK2 is connected to the wire of the third scan clock signal SCLK3, and the third clock signal input terminal CLK3 is connected to the wire of the sixth scan clock signal SCLK6. That is, nine scan clock signals SCLK1, SCLK2, SCLK3, SCLK4, SCLK5, SCLK6, SCLK7, SCLK8, and SCLK9 are inputted to the clock signal input terminals CLK1, CLK2, and CLK3 of the plurality of scan driving blocks 230_1, 230_2, 230_3, 230_4, 230_5, 230_6, 230_7, 230_8, and 230_9, . . . with nine types.

The floating signal input terminal FL of the scan driving blocks 230_1, 230_2, 230_3, 230_4, 230_5, 230_6, 230_7, 230_8, and 230_9, . . . are connected to the floating signal FLSa.

The scan driving blocks 230_1, 230_2, 230_3, 230_4, 230_5, 230_6, 230_7, 230_8, and 230_9, . . . output the scan signals Scan [1], Scan [2], Scan [3], Scan [4], Scan [5], Scan [6], Scan {7], Scan [8], Scan [9], . . . which are generated according to the signals inputted to the plurality of clock signal input terminals CLK1, CLK2, and CLK3, the floating signal input terminal FL, and the sequential input terminal IN to the scan signal output terminal OUT. The first scan driving block 230_1 to the n-th scan driving block (not shown) generate the sequential scan signals so as to transmit them to the plurality of scan lines S1-Sn.

Figure 10:
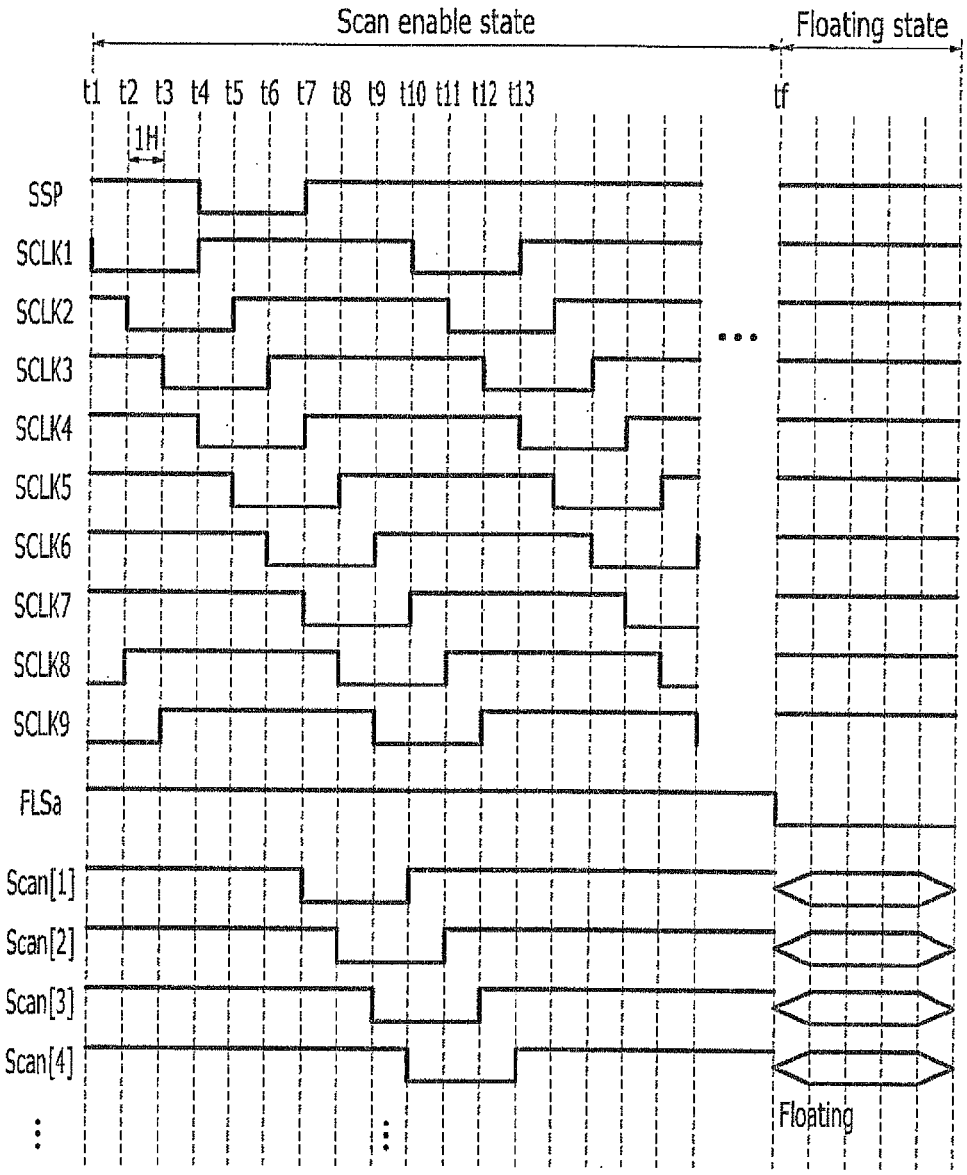
FIG. 10 is a timing diagram to explain a driving method of the scan driving apparatus of FIG. 9.

FIG. 10 is a timing diagram to explain a driving method of the scan driving apparatus of FIG. 9.

Referring to FIGS. 9 and 10, in the scan enable state, the voltage of the logic low level of the scan clock signal SCLK1, SCLK2, SCLK3, SCLK4, SCLK5, SCLK6, SCLK7, SCLK8, and SCLK9 have a positive width of three horizontal cycle 3H and are applied to be overlapped by two horizontal cycles 2H with the scan clock signal of the adjacent wire. The voltage of the logic low level of the scan clock signal SCLK1, SCLK2, SCLK3, SCLK4, SCLK5, SCLK6, SCLK7, SCLK8, and SCLK9 are applied so as to be repeated with the interval of six horizontal cycle 6H in which the voltage of the logic high level is applied. The cycle of the scan clock signal SCLK1, SCLK2, SCLK3, SCLK4, SCLK5, SCLK6, SCLK7, SCLK8, and SCLK9 is nine horizontal cycles, and the duty is three horizontal cycles.

The scan start signal SSP is applied with the voltage of the logic low level in the period t4-t7. The first scan clock signal SCLK1 in the period t1-t4, the second scan clock signal SCLK2 in the period t2-t5, the third scan clock signal SCLK3 in the period t3-t6, the fourth scan clock signal SCLK4 in the period t4-t7, the fifth scan clock signal SCLK5 in the period t5-t8, the sixth scan clock signal SCLK6 in the period t6-t9, the seventh scan clock signal SCLK7 in the period t7-t10, the eighth scan clock signal SCLK8 in the period t8-t11, and the ninth scan clock signal SCLK9 in the period t9-t12 are respectively applied with the voltage of the logic low level.

The first clock signal input terminal CLK1 of the first scan driving block 230_1 is inputted with the first scan clock signal SCLK1, the second clock signal input terminal CLK2 is inputted with the fourth scan clock signal SCLK4, and the third clock signal input terminal CLK3 is inputted with the seventh scan clock signal SCLK7. Accordingly, the first scan driving block 230_1 outputs the scan signal Scan [1] of the logic low level in the period t7-t10.

The first clock signal input terminal CLK1 of the second scan driving block 230_2 is inputted with the second scan clock signal SCLK2, the second clock signal input terminal CLK2 is inputted with the fifth scan clock signal SCLK5, and the third clock signal input terminal CLK3 is inputted with the eighth scan clock signal SCLK8. Accordingly, the second scan driving block 230_2 outputs the scan signal Scan [2] of the logic low level in the period t8-t11.

The first clock signal input terminal CLK1 of the third scan driving block 230_3 is inputted with the third scan clock signal SCLK3, the second clock signal input terminal CLK2 is inputted with the sixth scan clock signal SCLK6, and the third clock signal input terminal CLK3 is inputted with the ninth scan clock signal SCLK9. Accordingly, the third scan driving block 230_3 outputs the scan signal Scan [3] of the logic low level in the period t9-t12.

The first clock signal input terminal CLK1 of the fourth scan driving block 230_4 is inputted with the fourth scan clock signal SCLK4, the second clock signal input terminal CLK2 is inputted with the seventh scan clock signal SCLK7, and the third clock signal input terminal CLK3 is inputted with the first scan clock signal SCLK1. Accordingly, the fourth scan driving block 230_4 outputs the scan signal Scan [4] of the logic low level in the period t10-t13.

By this method, the scan driving apparatus may sequentially output the first scan signal Scan [1] to the n-th scan signal Scan [n] in the scan enable state. When the cycles of the scan clock signals SCLK1, SCLK2, SCLK3, SCLK4, SCLK5, SCLK6, SCLK7, SCLK8, and SCLK9 are nine horizontal cycles and the duty is three horizontal cycles, the plurality of scan signals having the duty of three horizontal cycles are shifted by one horizontal cycle and sequentially output to the plurality of scan lines S1-Sn.

The scan driving apparatus is operated with the floating state in which the scan signal output terminal OUT is floated from the time that the floating signal FLSa is applied with the voltage of the logic low level. Upon the operation of the floating state, the scan start signal SSP and the scan clock signals SCLK1, SCLK2, SCLK3, SCLK4, SCLK5, SCLK6, SCLK7, SCLK8, and SCLK9 are applied with the voltage of the logic high level. If the floating signal FLSa is again applied with the voltage of the logic high level, the scan driving apparatus is returned to the scan enable state, thereby outputting the scan signal.

The duty of the scan signal inputting the data to the pixel data is controlled according to the duty of the scan clock signal which is inputted to the scan driving block. Like the scan driving apparatus according to the first exemplary embodiment, the scan signal having the duty of one horizontal cycle may be output by using the scan clock signal having the duty of one horizontal cycle. Like the scan driving apparatus according to the second exemplary embodiment, the scan signal having the duty of two horizontal cycles may be outputted by using the scan clock signal having the duty of two horizontal cycles. Like the scan driving apparatus according to the third exemplary embodiment, the scan signal having the duty of three horizontal cycles may be outputted by using the scan clock signal having the duty of three horizontal cycles.

The scan driving apparatus (simultaneous driving apparatus) according to the fourth exemplary embodiment is now described.

Figure 11:
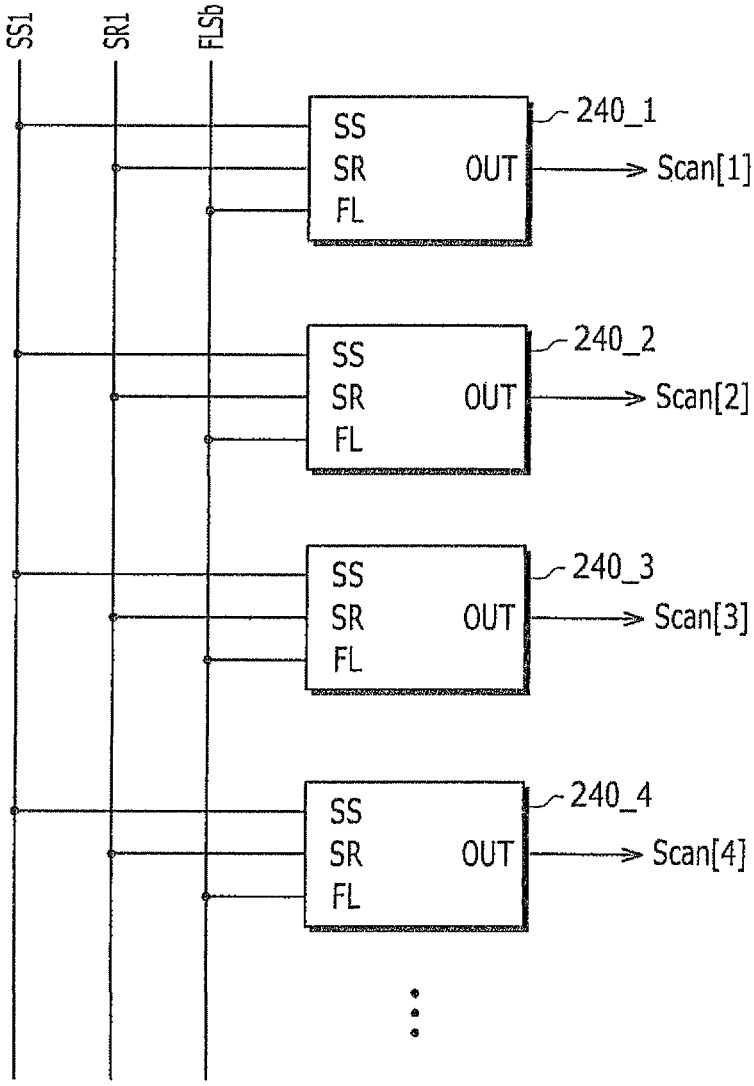
FIG. 11 is a block diagram of a configuration of a scan driving apparatus according to another exemplary embodiment of the present invention.

FIG. 11 is a block diagram showing a configuration of a scan driving apparatus according to another exemplary embodiment of the present invention.

Referring to FIG. 11, the scan driving apparatus according to the fourth exemplary embodiment includes a plurality of scan driving blocks 240_1, 240_2, 240_3, 240_4, . . . for generating a plurality of scan signals. The scan driving blocks 240_1, 240_2, 240_3, 240_4, . . . receive the input signal so as to generate the scan signals Scan [1], Scan [2], Scan [3], Scan [4], . . . which are transmitted to the plurality of scan lines S1-Sn.

The scan driving blocks 240_1, 240_2, 240_3, 240_4, . . . include the first control signal input terminal SS, the second control signal input terminal SR, the floating signal input terminal FL, and the scan signal output terminal OUT.

The input signal of the scan driving blocks 240_1, 240_2, 240_3, 240_4, . . . includes the first control signal SS1, the second control signal SR1, and the floating signal FLSb. The plurality of the control signals SS1 and SR1 and the floating signal FLSb are applied to different wires.

The first control signal input terminal SS of the scan driving blocks 240_1, 240_2, 240_3, 240_4, . . . is connected to the wire of the first control signal SS1, the second control signal input terminal SR is connected to the wire of the second control signal SR1, and the floating signal input terminal FL is connected to the wire of the floating signal FLSb.

The scan driving blocks 240_1, 240_2, 240_3, 240_4, . . . output the scan signals Scan [1], Scan [2], Scan [3], Scan [4], . . . , which that are generated according to the signals inputted to the first control signal input terminal SS, the second control signal input terminal SR, and the floating signal input terminal FL, to the scan signal output terminal OUT. The scan driving blocks 240_1, 240_2, 240_3, 240_4, . . . simultaneously output the scan signals Scan [1], Scan [2], Scan [3], Scan [4], . . . .

Figure 12:
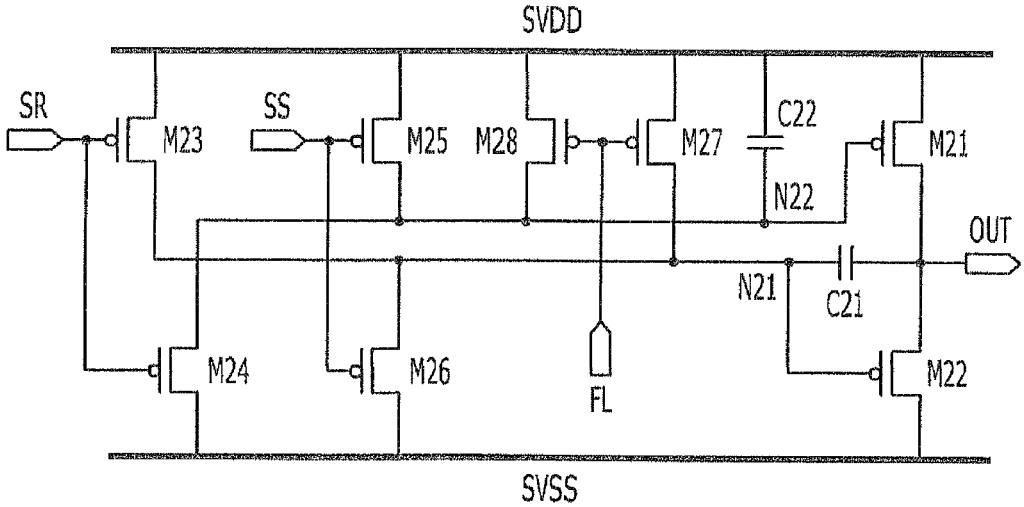
FIG. 12 is a circuit diagram of one example of a scan driving block included in the scan driving apparatus of FIG. 11.

FIG. 12 is a circuit diagram showing one example of a scan driving block included in the scan driving apparatus of FIG. 11.

Referring to FIG. 12, the scan driving block includes the first control signal input terminal SS, the second control signal input terminal SR, the scan signal output terminal OUT, a plurality of transistors M21, M22, M23, M24, M25, M26, M27, and M28, and a plurality of capacitors C21 and C22.

The first transistor M21 includes a gate electrode connected to the second node N22, one terminal connected to the power source SVDD, and another terminal connected to the scan signal output terminal OUT. The second transistor M22 includes a gate electrode connected to the first node N21, one terminal connected to the power source SVSS, and another terminal connected to the scan signal output terminal OUT. The third transistor M23 includes a gate electrode connected to the second control signal input terminal SR, one terminal connected to the power source SVDD, and another terminal connected to the first node N21. The fourth transistor M24 includes a gate electrode connected to the second control signal input terminal SR, one terminal connected to the power source SVSS, and another terminal connected to the second node N22. The fifth transistor M25 includes a gate electrode connected to the first control signal input terminal SS, one terminal connected to the power source SVDD, and another terminal connected to the second node N22. The sixth transistor M26 includes a gate electrode connected to the first control signal input terminal SS, one terminal connected to the power source SVSS, and another terminal connected to the first node N21. The seventh transistor M27 includes a gate electrode connected to the floating signal input terminal FL, one terminal connected to the power source SVDD, and another terminal connected to the first node N21. The eighth transistor M28 includes a gate electrode connected to the floating signal input terminal FL, one terminal connected to the power source SVDD, and another terminal connected to the second node N22.

The first capacitor C21 includes one terminal connected to the first node N21 and another terminal connected to the scan signal output terminal OUT. The second capacitor C22 includes one terminal connected to the power source SVDD and another terminal connected to the second node N22.

The first node N21 is connected to the gate electrode of the second transistor M22, the other terminal of the third transistor M23, the other terminal of the sixth transistor M26, the other terminal of the seventh transistor M27, and one terminal of the first capacitor C21. The second node N22 is connected to the gate electrode of the first transistor M21, the other terminal of the fourth transistor M24, the other terminal of the fifth transistor M25, the other terminal of the eighth transistor M28, and the other terminal of the second capacitor C22.

The power source SVDD is a power source having a voltage of the logic high level, and the power source SVSS is a power source having a voltage of the logic low level.

The plurality of transistors M21, M22, M23, M24, M25, M26, M27, and M28 are p-channel field effect transistors. The gate-on voltage for turning on the plurality of transistors M21, M22, M23, M24, M25, M26, M27, and M28 is the voltage of the logic low level and the gate-off voltage for turning them off is the voltage of the logic high level. At least one of the plurality of transistors M21, M22, M23, M24, M25, M26, M27, and M28 may be an n-channel field effect transistor, the gate-on voltage for turning on the n-channel field effect transistor is the voltage of the logic high level, and the gate-off voltage for turning them off is the voltage of the logic low level.

When the first control signal input terminal SS is applied with the voltage of the logic low level and the second control signal input terminal SR is applied with the voltage of the logic high level, the third transistor M23 and the fourth transistor M24 are turned off, and the fifth transistor M25 and the sixth transistor M26 are turned on. The power source SVDD is transmitted to the gate electrode of the first transistor M21 through the turned-on fifth transistor M25 to turn off the first transistor M21, and the power source SVSS is transmitted to the gate electrode of the second transistor M22 through the turned-on sixth transistor M26. Here, the voltage of the first node N21 is decreased less than the power source SVSS voltage by the bootstrap operation of the first capacitor C21. Accordingly, the second transistor M22 is completely turned on, and the power source SVSS is outputted to the scan signal output terminal OUT through the turned-on second transistor M22. That is, the scan signal of the logic low level is outputted.

When the first control signal input terminal SS is applied with the voltage of the logic high level and the second control signal input terminal SR is applied with the voltage of the logic low level, the fifth transistor M25 and the sixth transistor M26 are turned off, and the third transistor M23 and the fourth transistor M24 are turned on. The power source SVDD is transmitted to the gate electrode of the second transistor M22 through the turned-on third transistor M23 such that the second transistor M22 is turned off. The power source SVSS is transmitted to the gate electrode of the first transistor M21 through the turned-on fourth transistor M24 such that the first transistor M21 is turned on. The power source SVDD is outputted to the scan signal output terminal OUT through turned-on first transistor M21. That is, the scan signal of the logic high level is outputted.

If the floating signal input terminal FL is applied with the voltage of the logic high level, the seventh transistor M27 and the eighth transistor M28 are turned off, the voltages applied to the gate electrode of the first transistor M21 and the gate electrode of the second transistor M22 are not influenced. If the floating signal input terminal FL is applied with the voltage of the logic low level, the seventh transistor M27 and the eighth transistor M28 are turned on and the power source SVDD is transmitted to the gate electrode of the second transistor M22 through the turned-on seventh transistor M27 such that the second transistor M22 is turned off and the power source SVDD is transmitted to the gate electrode of the first transistor M21 through the turned-on eighth transistor M28 such that the first transistor M21 is turned off. Accordingly, the scan signal output terminal OUT is floated. Here, the first control signal input terminal SS and the second control signal input terminal SR are applied with the voltage of the logic high level.

Figure 13:
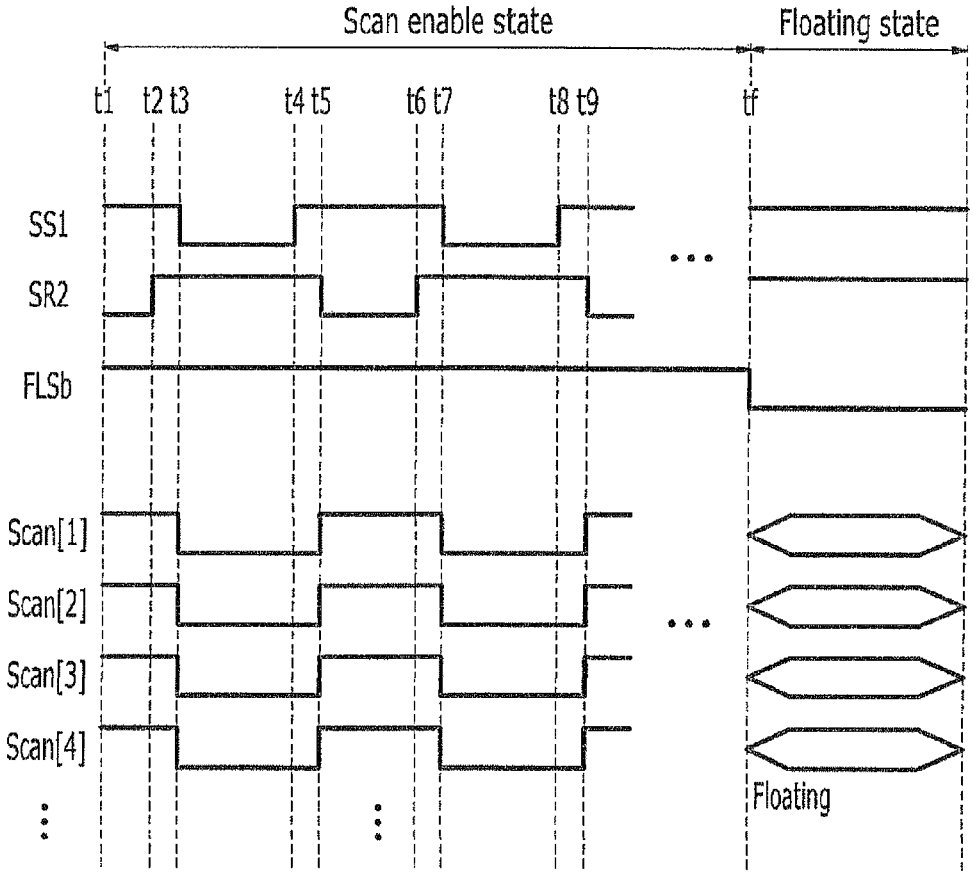
FIG. 13 is a timing diagram to explain a driving method of the scan driving apparatus of FIG. 11.

FIG. 13 is a timing diagram to explain a driving method of the scan driving apparatus of FIG. 11.

Referring to FIG. 11 to 13, the scan driving apparatus is operated with the scan enable state in which the floating signal FLSb is applied with the voltage of the logic high level, and with the floating state in which it is applied with the voltage of the logic low level.

In the scan enable state, the first control signal SS1 and the second control signal SR1 have different pulse widths, and are mainly applied with different polarities. For example, the first control signal SS1 is applied with the voltage of the logic high level in the period t1-t3, is applied with the voltage of the logic low level in the period t3-t4, and is applied with the voltage of the logic high level in the period t4-t7. Here, the second control signal SR1 is applied with the voltage of the logic low level in the period t1-t2, is applied with the voltage of the logic high level in the period t2-t5, and is applied with the voltage of the logic low level in the period t5-t6. That is, the period in which the first control signal SS1 is applied with the voltage of the logic low level is included in the period in which the second control signal SR1 is applied with the voltage of the logic high level, and the period in which the second control signal SR1 is applied with the voltage of the logic low level is included in the period in which the first control signal SS1 is applied with the voltage of the logic high level.

In the period t1-t2, the first control signal SS1 is applied with the voltage of the logic high level, and the second control signal SR1 is applied with the voltage of the logic low level. The scan driving blocks 240_1, 240_2, 240_3, 240_4, . . . respectively output the logic high level scan signals Scan [1], Scan [2], Scan [3], Scan [4], . . . , respectively.

In the period t2-t3, while the first control signal SS1 is applied with the voltage of the logic high level, the second control signal SR1 is converted into the voltage of the logic high level to be applied. The third transistor M23, the fourth transistor M24, the fifth transistor M25, and the sixth transistor M26 of the scan driving block are turned off. On the other hand, one terminal of the second capacitor C22 is applied with the power source SVDD in the period t1-t2 and the other terminal thereof is applied with the power source SVSS to be charged. That is, the second node N22 is formed with the power source SVSS, and the voltage formed at the second node N22 is applied to the gate electrode of the first transistor M21 in the period t2-t3 such that the first transistor M21 is turned on and the power source SVDD is outputted into the scan signal output terminal OUT through the turned on first transistor M21. That is, the scan driving blocks 240_1, 240_2, 240_3, 240_4, . . . output the scan signals Scan [1], Scan [2], Scan [3], Scan [4], . . . , respectively, of the logic high level.

In the period t3-t4, the first control signal SS1 is converted into the voltage of the logic low level to be applied, while the second control signal SR1 is applied with the voltage of the logic high level. The scan driving blocks 240_1, 240_2, 240_3, 240_4, . . . respectively output the scan signals Scan [1], Scan [2], Scan [3], Scan [4], . . . , respectively, of the logic low level.

In the state (in the period t1-t2) in which the first control signal SS1 is the voltage of the logic high level and the second control signal SR1 is the voltage of the logic low level, the second control signal SR1 is firstly converted into the voltage of the logic high level (at the time t2), and then the first control signal SS1 is converted into the voltage of the logic low level (at the time t3). Accordingly, this prevents a short circuit current from flowing from the power source SVDD to the power source SVSS which would otherwise reduce power consumption.

In the period t4-t5, while the second control signal SR1 is applied with the voltage of the logic high level, the first control signal SS1 is converted into a voltage of the logic high level and is applied. The voltage of the first node N21 becomes a voltage less than the power source SVSS by the bootstrap operation of the first capacitor C21. The voltage of the first node N21 is applied to the gate electrode of the second transistor M22 in the period t4-t5 such that the second transistor M22 is turned on, and the power source SVSS is outputted to the scan signal output terminal OUT through the turned-on second transistor M22. That is, the scan driving blocks 240_1, 240_2, 240_3, 240_4, . . . output scan signals Scan [1], Scan [2], Scan [3], Scan [4], . . . , respectively, of the logic low level.

In the period t5-t6, while the first control signal SS1 is applied with the voltage of the logic high level, the second control signal SR1 is converted into the voltage of the logic low level to be applied. The scan driving blocks 240_1, 240_2, 240_3, 240_4, . . . output the scan signal Scan [1], Scan [2], Scan [3], Scan [4], . . . , respectively, of the logic high level.

In the state in which the first control signal SS1 is the voltage of the logic low level and the second control signal SR1 is the voltage of the logic high level (the period t3-t4), the first control signal SS1 is converted into the voltage of the logic high level (the time t4), and then the second control signal SR1 is converted into the voltage of the logic low level (the time t5). Accordingly, this prevents a short circuit current flow from the power source SVDD to the power source SVSS with resultant reduction in power consumption.

In the period t6-t7, while the first control signal SS1 is applied with the voltage of the logic high level, the second control signal SR1 is converted into a voltage of the logic high level to be applied. The scan driving blocks 240_1, 240_2, 240_3, 240_4, . . . output the scan signal Scan [1], Scan [2], Scan [3], Scan [4], . . . , respectively, of the logic high level.

As described above, the scan signal of the logic low level is outputted from the time t3 when the first control signal SS1 is converted into the voltage of the logic low level to the time t5 when the second control signal SR1 is converted into the voltage of the logic low level.

The scan driving apparatus may control the pulse width of the first control signal SS1 and the second control signal SR1, and thereby the time that the scan signal of the logic low level is outputted to the plurality of scan line S1-Sn may be controlled.

The scan driving apparatus is operated from the time that the floating signal FLSb is applied with the voltage of the logic low level with the floating state in which the scan signal output terminal OUT is floated. Upon the operation of the floating state, the first control signal SS1 and the second control signal SR1 are applied with the voltage of the logic high level. If the floating signal FLSb is applied with the voltage of the logic low level, the first node N21 and the second node N22 are both applied with the power source SVDD such that the first transistor M21 and the second transistor M22 are turned off and the scan signal output terminal OUT assumes the floating state. Accordingly, the scan driving apparatus is not influenced by the other scan signals or control signals which are applied to the plurality of scan line S1-Sn in the state in which the output is floated.

If the floating signal FLSb is again applied with the voltage of the logic high level, the scan driving apparatus is returned to the scan enable state such that the light emitting signal may be outputted.

Figure 14:
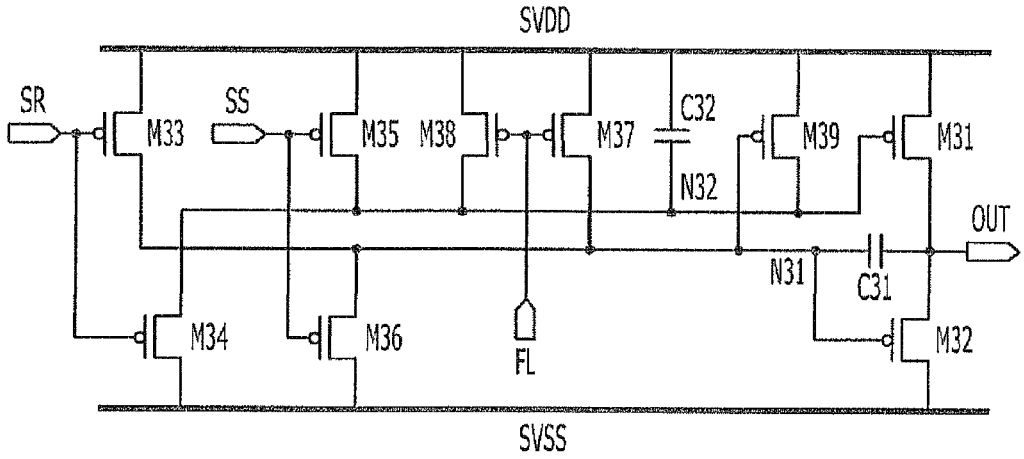
FIG. 14 is a circuit diagram of another example of a scan driving block included in the scan driving apparatus of FIG. 11.

FIG. 14 is a circuit diagram showing another example of a scan driving block included in the scan driving apparatus of FIG. 11.

Referring to FIG. 14, the scan driving block includes the first control signal input terminal SS, the second control signal input terminal SR, the scan signal output terminal OUT, a plurality of transistors M31, M32, M33, M34, M35, M36, M37, M38, and M39, and a plurality of capacitors C31 and C32.

In contrast to the scan driving block of FIG. 12, the scan driving block of FIG. 14 further includes the ninth transistor M39. The ninth transistor M39 includes a gate electrode connected to the first node N31, one terminal connected to the power source SVDD, and another terminal connected to the second node N32.

In the period in which the scan driving blocks 240_1, 240_2, 240_3, 240_4, . . . ) output the scan signals Scan [1], Scan [2], Scan [3], Scan [4], . . . , respectively, of the logic low level (e.g., the period t3-t5), a voltage less than the power source SVSS is formed at first node N31 by the bootstrap operation of the first capacitor C31, the voltage of the first node N31 turns on the ninth transistor M39, and the power source SVDD is transmitted to the second node N32 through the turned-on ninth transistor M39 such that the voltage of the second node N32 may be further surely maintained as the power source SVDD.

Figure 15:
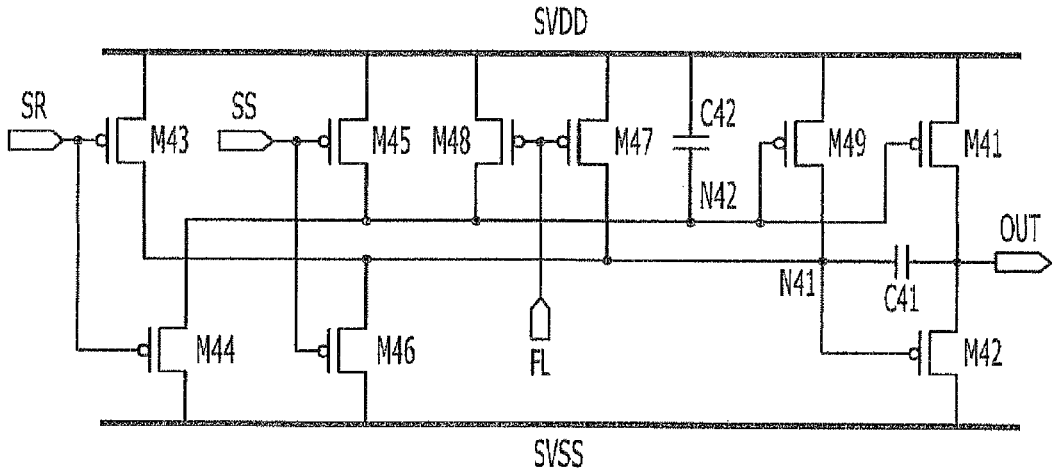
FIG. 15 is a circuit diagram of another example of a scan driving block included in the scan driving apparatus of FIG. 11.

FIG. 15 is a circuit diagram showing another example of a scan driving block included in the scan driving apparatus of FIG. 11.

Referring to FIG. 15, the scan driving block includes the first control signal input terminal SS, the second control signal input terminal SR, the scan signal output terminal OUT, a plurality of transistors M41, M42, M43, M44, M45, M46, M47, M48, and M49, and a plurality of capacitors C41 and C42.

In contrast to the scan driving block of FIG. 12, the scan driving block of FIG. 15 further includes the ninth transistor M49. The ninth transistor M49 includes a gate electrode connected to the second node N42, one terminal connected to the power source SVDD, and another terminal connected to the first node N41.

In the period in which the scan driving blocks 240_1, 240_2, 240_3, 240_4, . . . ) output the scan signals Scan [1], Scan [2], Scan [3], Scan [4], . . . , respectively, of the logic low level (e.g., the period t5-t7), the power source SVSS is formed at the second node N42, the power source SVSS of the second node N42 turns on the ninth transistor M49, and the power source SVDD is transmitted to the first node N41 through the turned-on ninth transistor M49 such that the voltage of the first node N41 may be further surely maintained as the power source SVDD.

Figure 16:
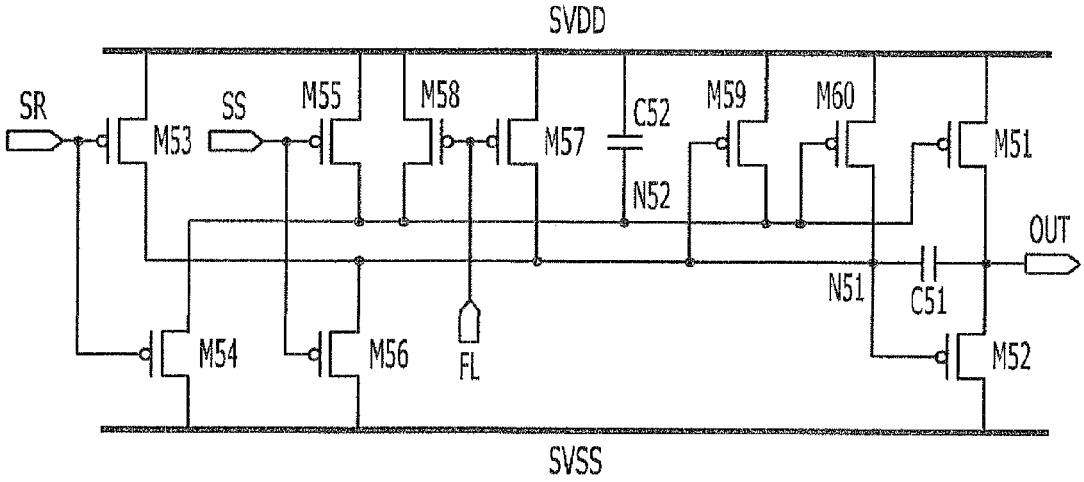
FIG. 16 is a circuit diagram of another example of a scan driving block included in the scan driving apparatus of FIG. 11.

FIG. 16 is a circuit diagram showing another example of a scan driving block included in the scan driving apparatus of FIG. 11.

Referring to FIG. 16, the scan driving block includes the first control signal input terminal SS, the second control signal input terminal SR, the scan signal output terminal OUT, a plurality of transistors M51, M52, M53, M54, M55, M56, M57, M58, M59, and M60, and a plurality of capacitors C51 and C52.

In contrast to the scan driving block of FIG. 12, the scan driving block of FIG. 15 further includes the ninth transistor M59 and the tenth transistor M60. The ninth transistor M59 includes a gate electrode connected to the first node N51, one terminal connected to the power source SVDD, and another terminal connected to the second node N52. The tenth transistor M60 includes a gate electrode connected to the second node N52, one terminal connected to the power source SVDD, and another terminal connected to the first node N51.

In the period in which the scan driving blocks 240_1, 240_2, 240_3, 240_4, . . . ) output the scan signals Scan [1], Scan [2], Scan [3], Scan [4], . . . , respectively, of the logic low level (e.g., the period t3-t5), the power source SVSS is formed at the first node N51, the power source SVSS of the first node 512 turns on the ninth transistor M59, and the power source SVDD is transmitted to the second node N52 through the turned-on ninth transistor M49 such that the voltage of the second node N52 may be further surely maintained as the power source SVDD. In the period in which the scan driving blocks 240_1, 240_2, 240_3, 240_4, . . . output the scan signals Scan [1], Scan [2], Scan [3], Scan [4], . . . , respectively, of the logic high level (e.g., the period t5-t7), the power source SVSS is formed at the second node N52, the power source SVSS of the second node N52 turns on the tenth transistor M60, and the power source SVDD is transmitted to the first node N51 through the turned-on tenth transistor M60 such that the voltage of the first node N51 may be further surely maintained as the power source SVDD.

The drawings and the detailed description described above are examples of the present invention which are provided to explain the present invention, but the scope of the present invention described in the claims is not limited thereto. Therefore, it will be appreciated by those skilled in the art that various modifications may be made without departing from the scope of the invention, and other equivalent embodiments are available. Accordingly, the actual scope of the present invention must be determined by the spirit and scope of the appended claims.

What is claimed is:

1. A scan driving apparatus, comprising:

a first driving apparatus connected to a plurality of scan lines; and a second driving apparatus connected to the plurality of scan lines, wherein, when one of the first driving apparatus and the second driving apparatus is in a scan enable state such that the plurality of scan lines are applied with a scan signal, the other of the first driving apparatus and the second driving apparatus is in a floating state such that an output terminal is floated, wherein at least one of the first driving apparatus and the second driving apparatus includes a plurality of scan driving blocks respectively connected to the plurality of scan lines;

the plurality of scan driving blocks including:

a first scan driving block for outputting a second clock signal to a first output terminal according to an input signal in synchronization with a first clock signal, and for outputting a first voltage to the first output terminal according to a third clock signal;

a second scan driving block for outputting the third clock signal to a second output terminal in synchronization with a second clock signal according to the second clock signal output by the first scan driving block, and for outputting the first voltage to the second output terminal according to the first clock signal; and a third scan driving block for outputting the first clock signal to a third output terminal synchronization with the third clock signal according to the third clock signal output by the second scan driving block, and for outputting the first voltage to the third output terminal according to the second clock signal;

wherein the first, second and third output terminals are floated from the first, second and third scan driving blocks according to a floating signal.

2. The scan driving apparatus of claim 1, wherein the first driving apparatus sequentially applies the plurality of scan signals to the plurality of scan lines.

3. The scan driving apparatus of claim 2, wherein the second driving apparatus simultaneously applies the plurality of scan signals to the plurality of scan lines.

4. The scan driving apparatus of claim 1, wherein the first driving apparatus sequentially applies the plurality of scan signals to the plurality of scan lines and the second driving apparatus applies a control signal to the plurality of scan lines after the output terminal of the first driving apparatus is floated.

5. The scan driving apparatus of claim 1, wherein the first driving apparatus simultaneously applies the plurality of scan signals to the plurality of scan lines and the second driving apparatus applies a control signal to the plurality of scan lines after the output terminal of the first driving apparatus is floated.

6. A scan driving apparatus, comprising:

a first scan driving block for outputting a second clock signal to a first output terminal according to an input signal in synchronization with a first clock signal, and for outputting a first voltage to the first output terminal according to a third clock signal;

a second scan driving block for outputting the third clock signal to a second output terminal in synchronization with a second clock signal according to the second clock signal output signal of the first scan driving block, and for outputting the first voltage to the second output terminal according to the first clock signal; and a third scan driving block for outputting the first clock signal to a third output terminal in synchronization with the third clock signal according to the third clock signal output by the second scan driving block, and for outputting the first voltage to the third output terminal according to the second clock signal;

wherein the first, second and third output terminals are floated from the first, second and third scan driving blocks according to a floating signal.

7. The scan driving apparatus of claim 6, wherein the second clock signal is a signal by which the first clock signal is shifted by a duty of the first clock signal, and the third clock signal is a signal by which the second clock signal is shifted by a duty of the second clock signal.

8. The scan driving apparatus of claim 7, wherein the first scan driving block includes:

a first transistor turned on by the second voltage transmitted according to the third clock signal and transmitting the first voltage to the first output terminal;

a second transistor turned on by the input signal transmitted according to the first clock signal and transmitting the second clock signal to the first output terminal;

a third transistor for transmitting the first voltage to a gate electrode of the first transistor according to the floating signal so as to turn off the first transistor; and a fourth transistor for transmitting the first voltage to a gate electrode of the second transistor according to the floating signal so as to turn off the second transistor.

9. The scan driving apparatus of claim 7, wherein the second scan driving block includes:

a first transistor turned on by the second voltage transmitted according to the first clock signal and transmitting the first voltage to the second output terminal;

a second transistor turned on by the output signal of the first scan driving block transmitted according to the second clock signal and transmitting the third clock signal to the second output terminal;

a third transistor for transmitting the first voltage to a gate electrode of the first transistor according to the floating signal so as to turn off the first transistor; and a fourth transistor for transmitting the first voltage to a gate electrode of the second transistor according to the floating signal so as to turn off the second transistor.

10. The scan driving apparatus of claim 7, wherein the third scan driving block includes:

a first transistor turned on by the second voltage transmitted according to the second clock signal and transmitting the first voltage to the third output terminal;

a second transistor turned on by an output signal of the second scan driving block transmitted according to the third clock signal and transmitting the first clock signal to the third output terminal;

a third transistor for transmitting the first voltage to a gate electrode of the first transistor according to the floating signal so as to turn off the first transistor; and a fourth transistor for transmitting the first voltage to a gate electrode of the second transistor according to the floating signal so as to turn off the second transistor.

11. A scan driving apparatus, comprising:

a plurality of scan driving blocks respectively connected to a plurality of scan lines, the plurality of scan driving blocks including:

a first scan driving block for outputting a second clock signal to a first output terminal according to an input signal in synchronization with a first clock signal, and for outputting a first voltage to the first output terminal according to a third clock signal;

a second scan driving block for outputting the third clock signal to a second output terminal in synchronization with a second clock signal according to the second clock signal output by the first scan driving block, and for outputting the first voltage to the second output terminal according to the first clock signal; and a third scan driving block for outputting the first clock signal to a third output terminal in synchronization with the third clock signal according to the third clock signal output by the second scan driving block, and for outputting the first voltage to the third output terminal according to the second clock signal;

wherein the first, second and third output terminals are connected to a corresponding scan line, and each of the plurality of scan driving blocks includes a first transistor for transmitting a voltage of a logic high level to the corresponding output terminal and a second transistor for transmitting a voltage of a logic low level to the corresponding output terminal, and a voltage for turning off the first transistor and the second transistor is transmitted to a gate electrode of the first transistor and a gate electrode of the second transistor according to a floating signal floating the corresponding output terminal.

12. The scan driving apparatus of claim 11, wherein each scan driving block further includes:

a floating signal input terminal for receiving a floating signal as an input;

a third transistor for transmitting a voltage for turning off the first transistor to the gate electrode of the first transistor according to the floating signal; and a fourth transistor for transmitting a voltage for turning off the second transistor to the gate electrode of the second transistor according to the floating signal.

13. The scan driving apparatus of claim 12, wherein the first transistor is a p-channel field effect transistor.

14. The scan driving apparatus of claim 13, wherein the third transistor includes:

a gate electrode connected to the floating signal input terminal;

one terminal connected to a power source having the voltage of the logic high level; and another terminal connected to the gate electrode of the first transistor.

15. The scan driving apparatus of claim 12, wherein the second transistor is a p-channel field effect transistor.

16. The scan driving apparatus of claim 15, wherein the fourth transistor includes:

a gate electrode connected to the floating signal input terminal;

one terminal connected to a power source having the voltage of the logic high level; and another terminal connected to the gate electrode of the second transistor.

17. The scan driving apparatus of claim 11, wherein the plurality of scan driving blocks further include a sequential input terminal for receiving one of a scan start signal and the output signal of an adjacent scan driving block as an input.

18. The scan driving apparatus of claim 17, wherein the plurality of scan driving blocks further include:

a fifth transistor turned on by a first scan clock signal and transmitting a voltage for turning on the first transistor to the gate electrode of the first transistor;

a sixth transistor turned on by a second scan clock signal and transmitting a signal inputted to the sequential input terminal to the gate electrode of the second transistor; and a seventh transistor turned on by the signal inputted to the sequential input terminal and transmitting a voltage for turning off the first transistor to the gate electrode of the first transistor.

19. The scan driving apparatus of claim 18, wherein the plurality of scan driving blocks sequentially output scan signals to a plurality of scan lines according to the signal inputted to the sequential inputted terminal.

20. The scan driving apparatus of claim 11, wherein the plurality of scan driving blocks further include:

a fifth transistor turned on by a first control signal and transmitting a voltage for turning off the first transistor to the gate electrode of the first transistor;

a sixth transistor turned on by the first control signal and transmitting a voltage for turning on the second transistor to the gate electrode of the second transistor;

a seventh transistor turned on by a second control signal and transmitting a voltage for turning off the second transistor to the gate electrode of the second transistor; and an eighth transistor turned on by the second control signal and transmitting a voltage for turning on the first transistor to the gate electrode of the first transistor.

21. The scan driving apparatus of claim 20, wherein the plurality of scan driving blocks simultaneously apply scan signals to a plurality of scan lines according to the first control signal and the second control signal.

22. The scan driving apparatus of claim 20, further comprising a ninth transistor turned on by the voltage for turning on the second transistor and transmitting the voltage for turning off the first transistor to the gate electrode of the first transistor.

23. The scan driving apparatus of claim 20, further comprising a tenth transistor turned on by the voltage for turning on the first transistor and transmitting the voltage for turning off the second transistor to the gate electrode of the second transistor.

24. A display device, comprising:

a display unit including a plurality of pixels;

a data driver for applying a data signal to a plurality of data lines connected to the plurality of pixels; and a scan driver for applying a scan signal to a plurality of scan lines connected to the plurality of pixels for the data signal to be applied to the plurality of pixels;

wherein the scan driver includes a first driving apparatus connected to the plurality of scan lines and a second driving apparatus connected to the plurality of scan lines, and when one of the first driving apparatus and the second driving apparatus is in a scan enable state such that the plurality of scan lines are applied with a scan signal, the other of the first driving apparatus and the second driving apparatus is in a floating state such that the output terminal is floated, at least one of the first driving apparatus and the second driving apparatus includes as plurality of scan driving blocks respectively connected to the plurality of scan lines;

the plurality of scan driving blocks including:

a first scan driving block for outputting a second clock signal to a first output terminal according to an input signal in synchronization with a first clock signal, and for outputting a first voltage to the first output terminal according to a third clock signal;

a second scan driving block for outputting the third clock signal to a second output terminal in synchronization with a second clock signal according to the second clock signal output by the first scan driving block, and for outputting the first voltage to the second output terminal according to the first clock signal; and a third scan driving block for outputting the first clock signal to a third output terminal in synchronization with the third clock signal according to the third clock signal output by the second scan driving block, and for outputting the first voltage to the third output terminal according to the second clock signal;

wherein the first, second and third output terminals are floated from the first, second and third scan driving blocks according to a floating signal.

25. The display device of claim 24, wherein the first driving apparatus sequentially applies a plurality of scan signals to the plurality of scan lines.

26. The display device of claim 25, wherein the second driving apparatus simultaneously applies the plurality of scan signals to the plurality of scan lines.

27. The display device of claim 25, wherein the first driving apparatus sequentially applies the plurality of scan signals to the plurality of scan lines and the second driving apparatus applies a control signal to the plurality of scan lines after the output terminal of the first driving apparatus is floated.

28. The display device of claim 24, wherein the first driving apparatus simultaneously applies the plurality of scan signals to the plurality of scan lines and the second driving apparatus applies a control signal to the plurality of scan lines after the output terminal of the first driving apparatus is floated.

* * * * *